United States Patent [19]

Nakamura et al.

[11] 4,113,374

[45] Sep. 12, 1978

[54] ELECTROPHOTOGRAPHIC COPYING APPARATUS

[75] Inventors: Yoshihiro Nakamura, Toyokawa; Kenji Shibazaki, Aichi; Tateomi Kono, Toyokawa; Syotaro Inagaki, Okazaki; Tomoji Murata, Toyokawa, all of Japan

[73] Assignee: Minolta Camera Kabushiki Kaisha, Azuchi, Japan

[21] Appl. No.: 736,189

[22] Filed: Oct. 27, 1976

[30] Foreign Application Priority Data

Oct. 29, 1975 [JP] Japan ..... 50-130732

[51] Int. Cl.[2] ..... G03G 21/00

[52] U.S. Cl. ..... 355/14

[58] Field of Search ..... 355/3 R, 14

[56] References Cited

U.S. PATENT DOCUMENTS

| | | | |
|---|---|---|---|
| 3,960,446 | 6/1976 | Ogawa et al. | 355/14 X |
| 4,025,180 | 5/1977 | Kurita et al. | 355/3 R |
| 4,027,965 | 6/1977 | Mikasa et al. | 355/14 X |

*Primary Examiner*—A. D. Pellinen
*Attorney, Agent, or Firm*—Wenderoth, Lind & Ponack

[57] ABSTRACT

The present invention is an electrophotographic copying apparatus which includes a group of switches disposed along the path of the copy paper. These switches are so arranged as to control the functions of corona charging, exposure and aligning the forward edge of the image formed on the photoreceptor with the leading edge of the copy paper, while the starting of the transfer device and the function of the copy paper separation device are controlled through a control cam which is driven by actuating signals produced by one of these switches. Since the developing and transfer functions are arranged to be suspended by a drum cam rotating as one unit with the photoreceptor drum, the possibility of copy paper jamming is decreased to a large extent through reduction of the number of switches employed, while undesirable developing and transfer at the slot portion or seam portion of the photoreceptor are advantageously eliminated.

10 Claims, 25 Drawing Figures

ELECTROPHOTOGRAPHIC COPYING APPARATUS

Figure 1:
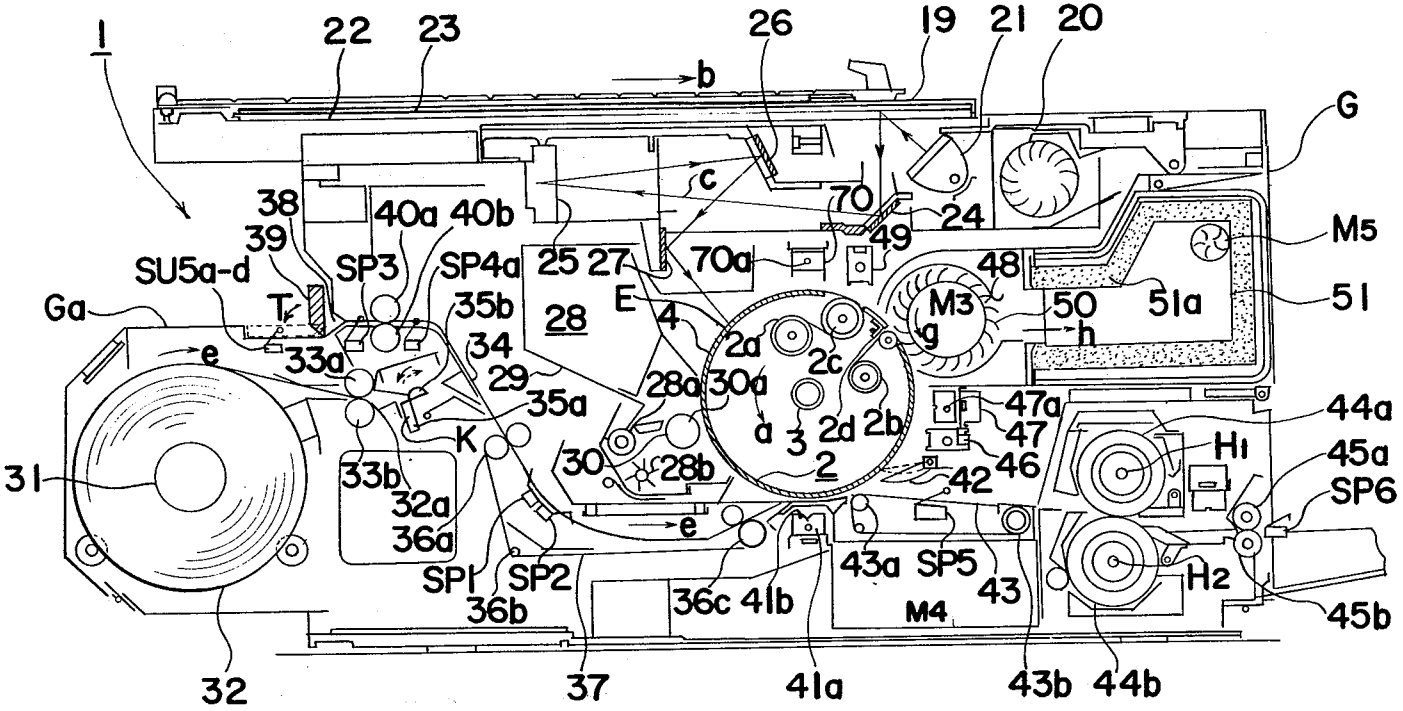

The present invention relates to a copying apparatus, and more particularly, to an electrophotographic copying apparatus of the transfer type.

Conventionally, in a transfer type electrophotographic copying apparatus based on a xerographic or similar system, an electrostatic latent image of the original to be copied is formed in a known manner on a photoreceptor layer disposed on the outer periphery of a rotatable photoreceptor drum, and is subsequently developed into a visible toner powder image, which is then transferred onto a transfer material such as copy paper sheet. The toner powder image thus transferred is further fixed onto the transfer material, for example, by heat fusing to obtain copied images.

The known transfer type electrophotographic copying apparatus of the above described type consequently includes various processes such as preliminary charging the photoreceptor surface of the photoreceptor drum by a corona charger, projecting the light images of the original through an optical system onto the photoreceptor surface for the formation of the latent image thereon, developing the latent image to obtain the visible toner image, transferring the toner powder image onto the copy paper sheet, separating the copy paper sheet from the photoreceptor drum after the transfer, cleaning the photoreceptor surface after the separation of the copy paper sheet, and heating the separated copy paper sheet for fixing the copied image thereon, in which processes it is necessary that the forward edge of the image formed on the photoreceptor surface coincides with the corresponding leading edge of the copy paper sheet to obtain the copied image of the original on a predetermined position of the copy paper sheet. Especially, in cases where the photoreceptor drum has an axially formed slot so that a sheet-like photoreceptor housed in the drum can be led through the slot around the drum outer periphery for necessary replacement of the photoreceptor, it is essential to prevent the image of such a discontinuity i.e., the slot or seam of the photoreceptor, from being formed in the copied image. Additionally, should jamming of the copy paper sheet arise in any of the above described processes, such trouble must immediately be detected for quick remedy.

Although various electrophotographic copying apparatuses provided with arrangements for synchronizing the image with the copy paper sheet, and also for preventing jamming of the copy paper sheet have been conventionally proposed, there have been none that fully meet the requirements.

Accordingly, an essential object of the present invention is to provide an electrophotographic copying apparatus of the transfer type in which jamming of copy paper sheet is positively detected through a timed relation between a drum cam and a switch means disposed on the copy paper path.

Another important object of the present invention is to provide an electrophotographic copying apparatus of the above described type in which each of the copying processes are effected in accurate synchronization with the alignment between the forward edge of the image formed on the photoreceptor and the leading edge of the copy paper assured by a simple control circuit through the employment, of a control cam, other than the drum cam, rotating independently of the drum cam, and in which developing and transferring at a discontinuity, i.e., at the slot of the photoreceptor drum or at a seam of the photoreceptor are positively prevented, with substantial elimination of the disadvantages inherent in the conventional electrophotographic copying apparatuses of this kind.

A further object of the present invention is to provide an electrophotographic copying apparatus of the above described type which is accurate in functioning and simple in construction, with a consequent reduction in manufacturing cost.

According to a preferred embodiment of the present invention, the electrophotographic copying apparatus includes a group of switches disposed along a path of the copy paper. These switches are so arranged as to control the functions of corona charging, exposure and aligning the forward edge of the image formed on the photoreceptor with the leading edge of the copy paper, while the starting of the transfer device and the function of the copy paper separation device are controlled through a control cam which is driven by actuating signals produced by one of these switches. Meanwhile, since the developing and transfer functions are arranged to be suspended by a drum cam rotating as one unit with the photoreceptor drum, the possibility of copy paper jamming is decreased to a large extent through reduction of the number of switches employed, while undesirable developing and transfer at the slot portion or seam portion of the photoreceptor are advantageously eliminated.

Figure 2:
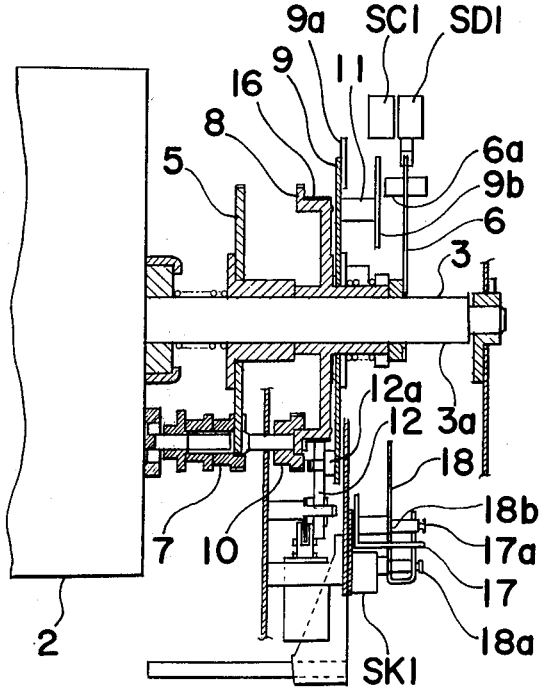
Figure 3:
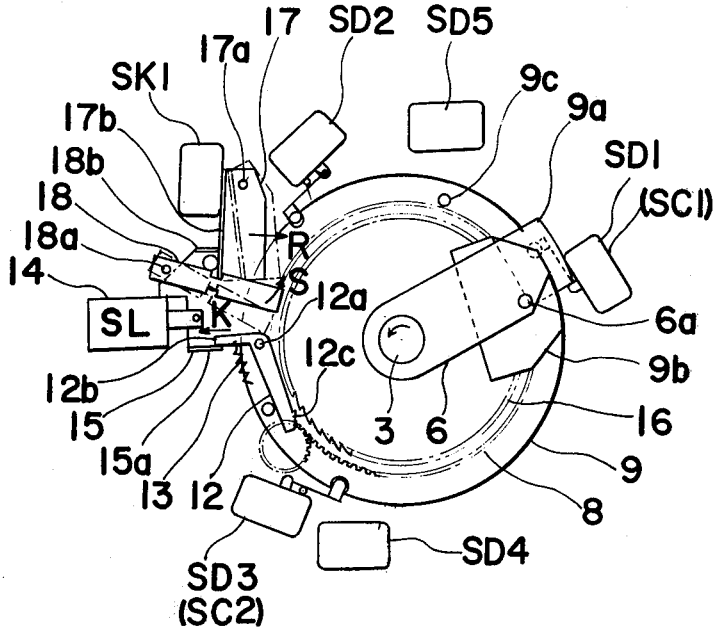
Figure 4:
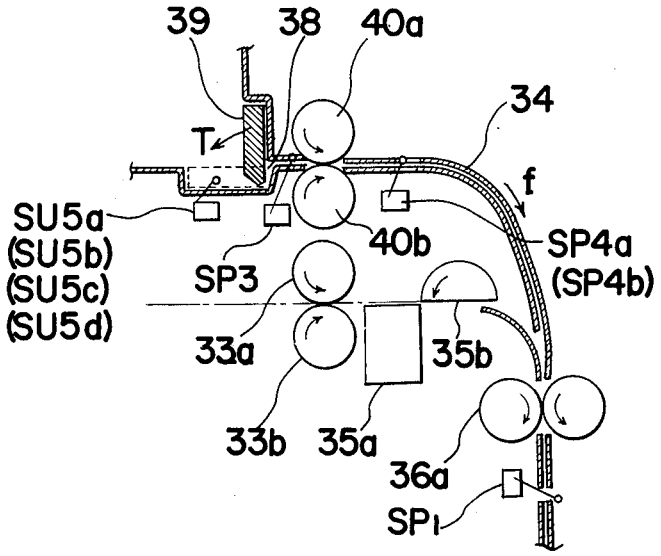
Figure 5:
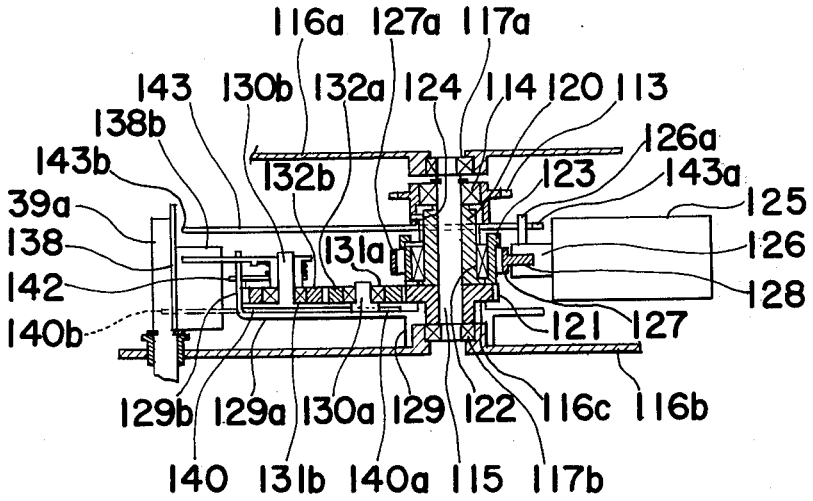
Figure 6:
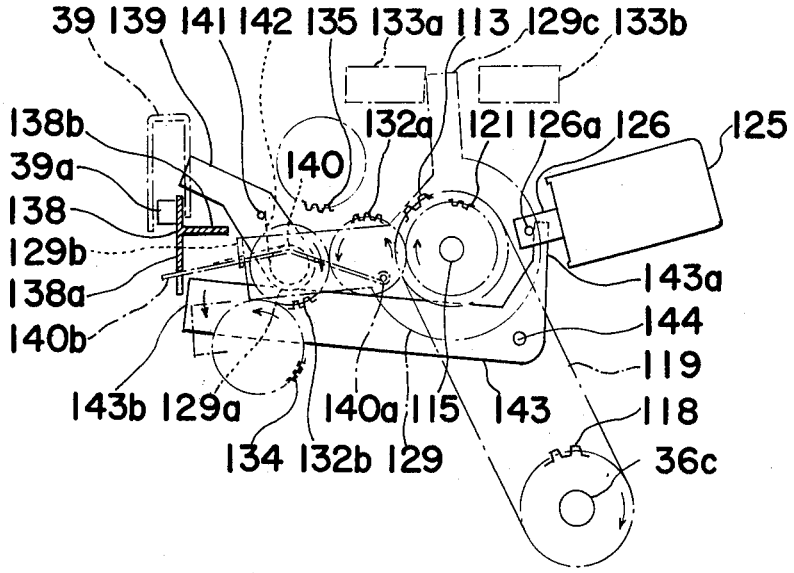
Figure 7:
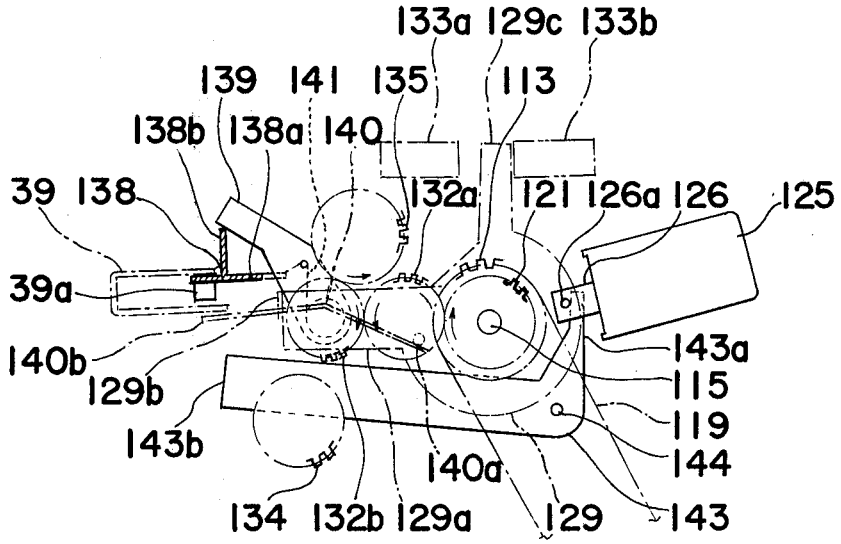
Figure 8:
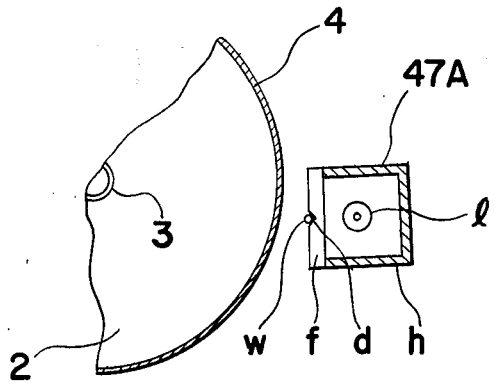
Figure 9:
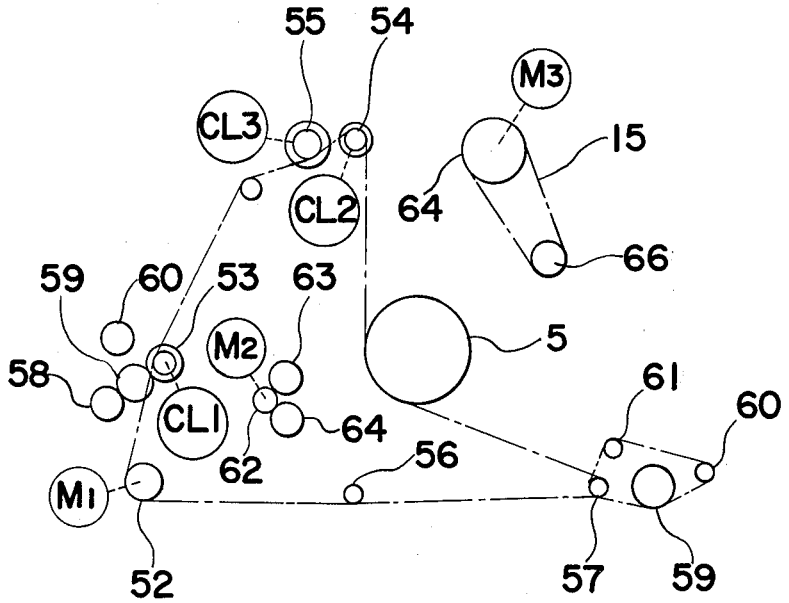
Figure 10:
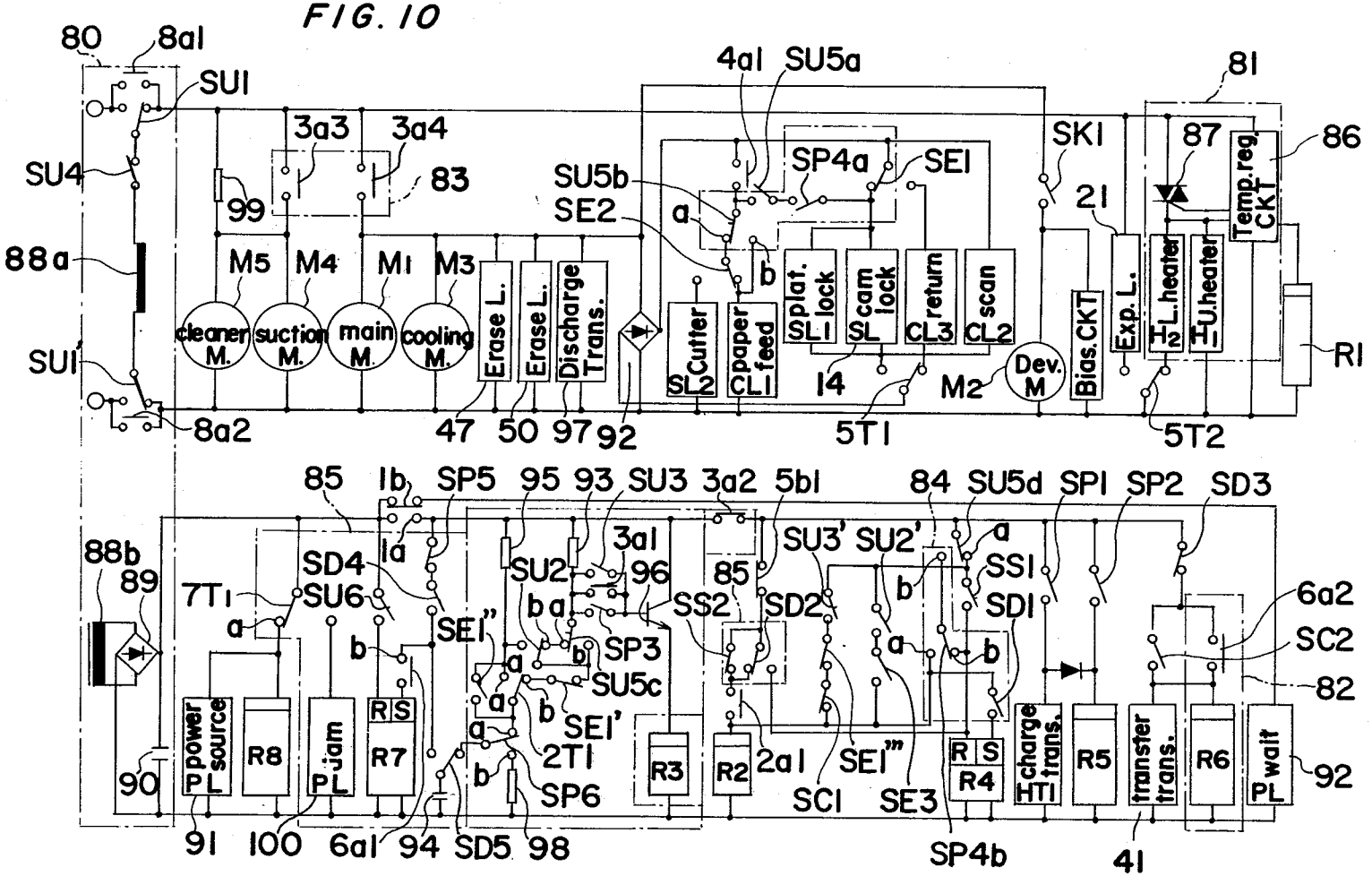
Figure 11:
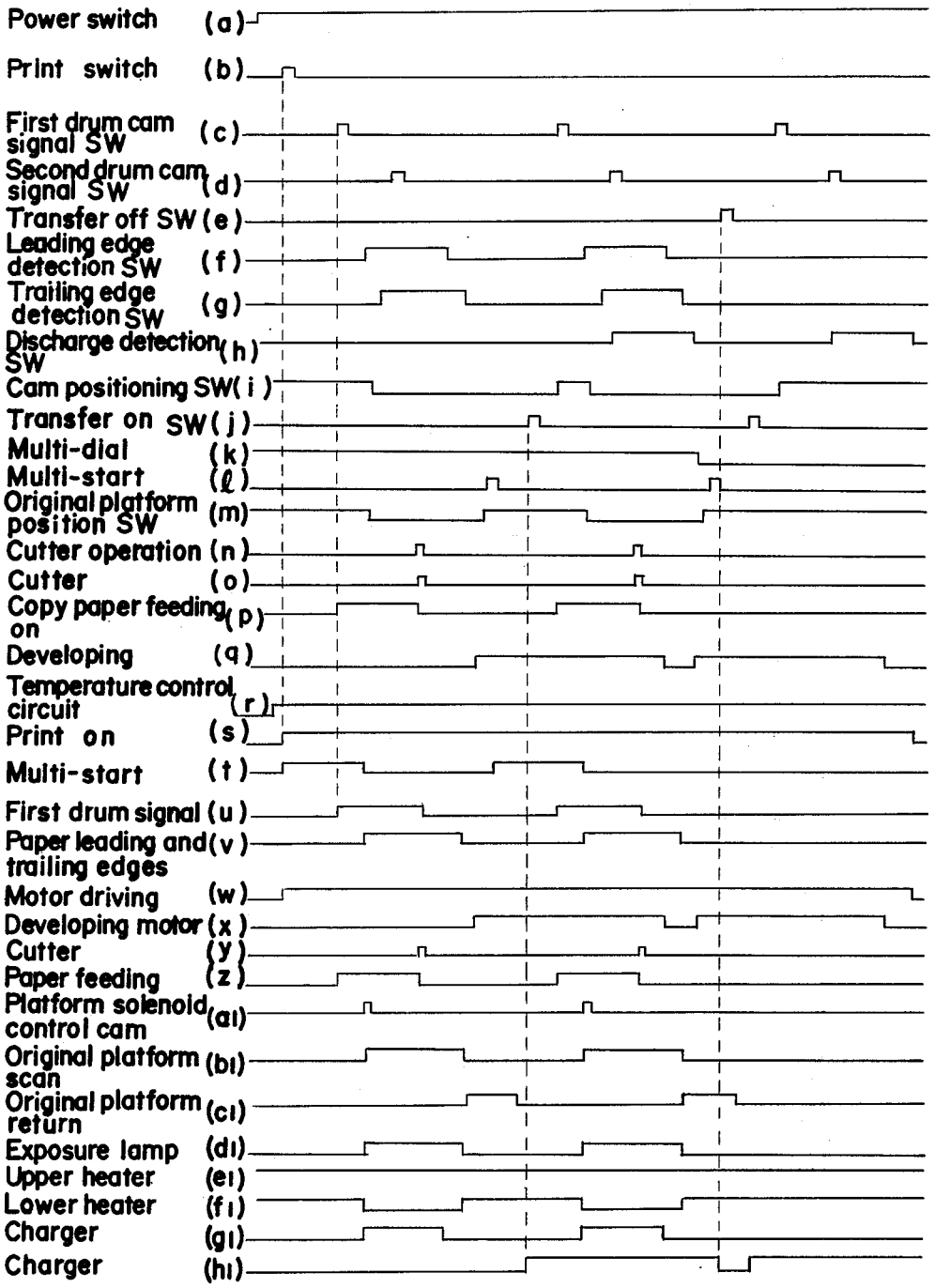
Figure 12:
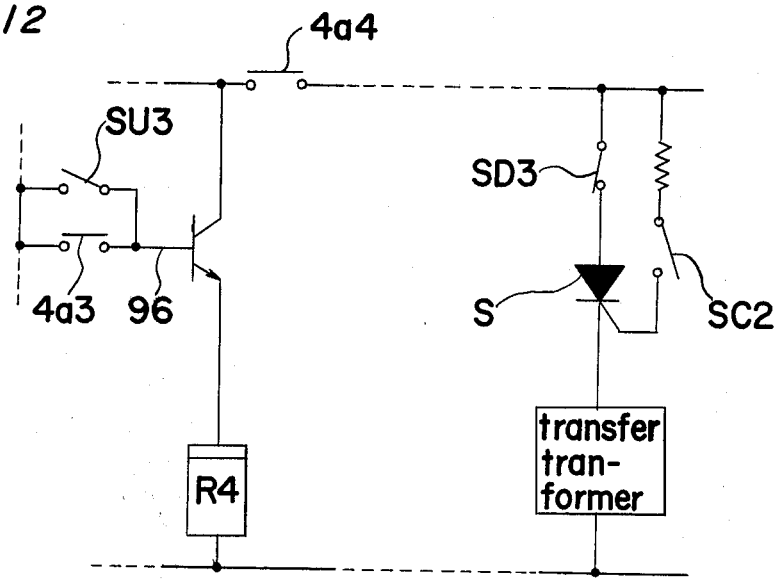
Figure 13:
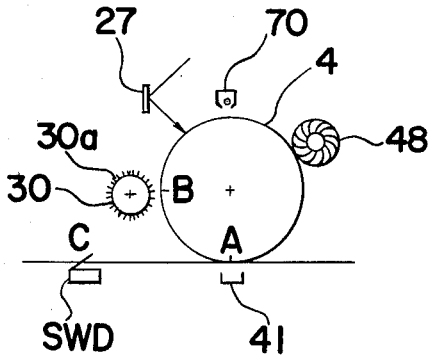
Figure 14:
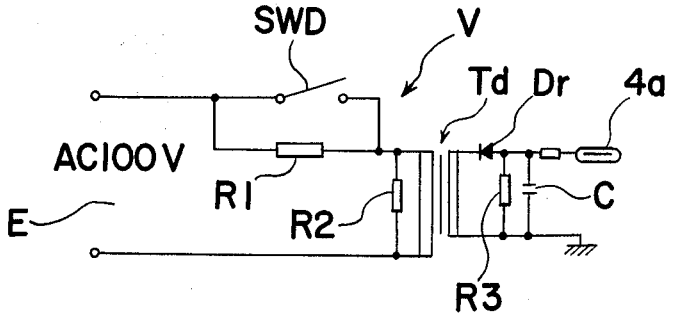
Figure 15:
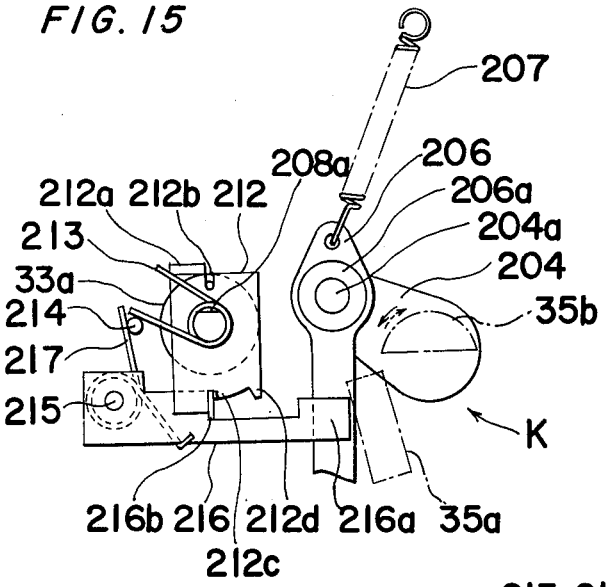
Figure 16:
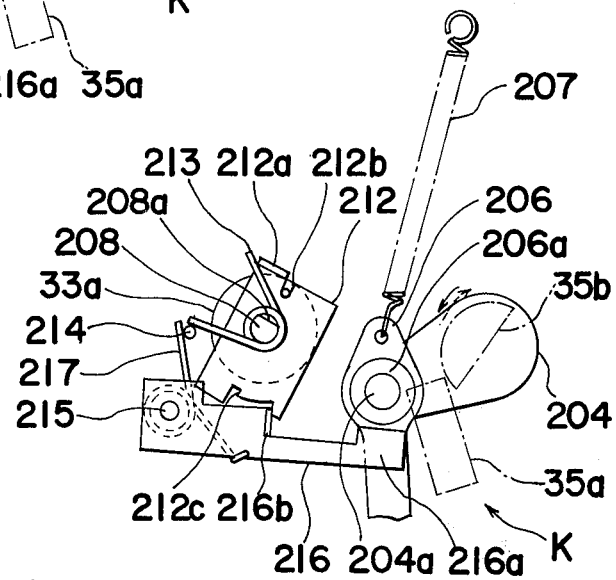
Figure 17:
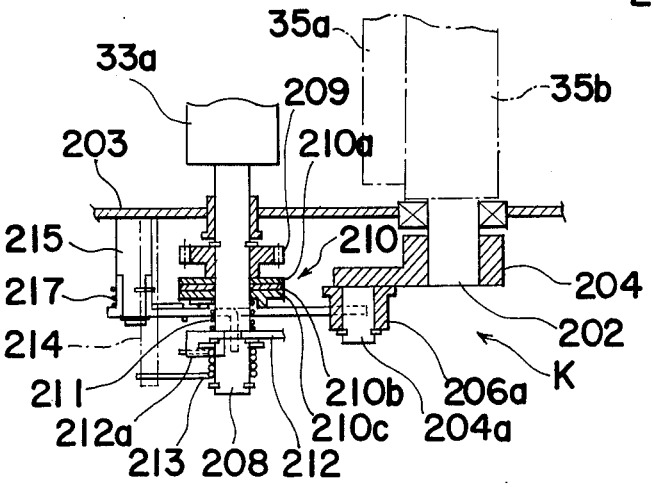
Figure 18:
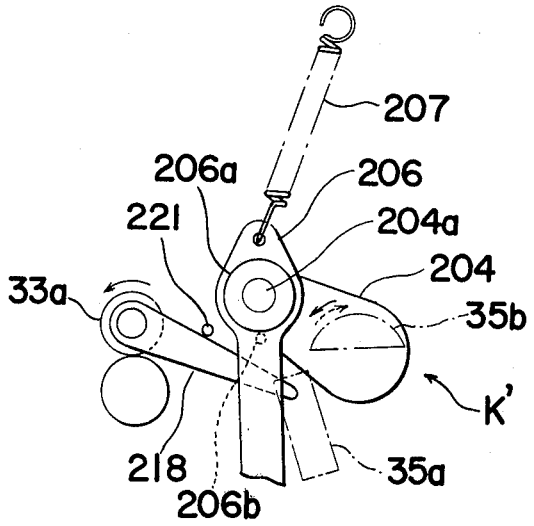
Figure 19:
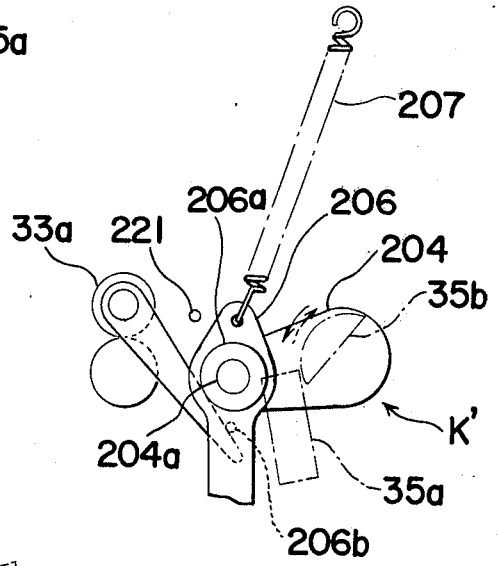
Figure 20:
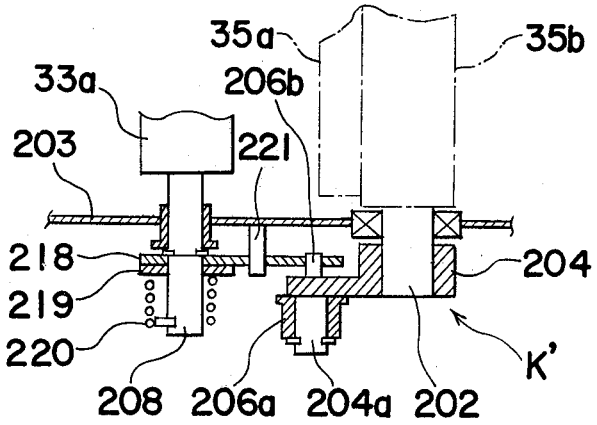
Figure 21:
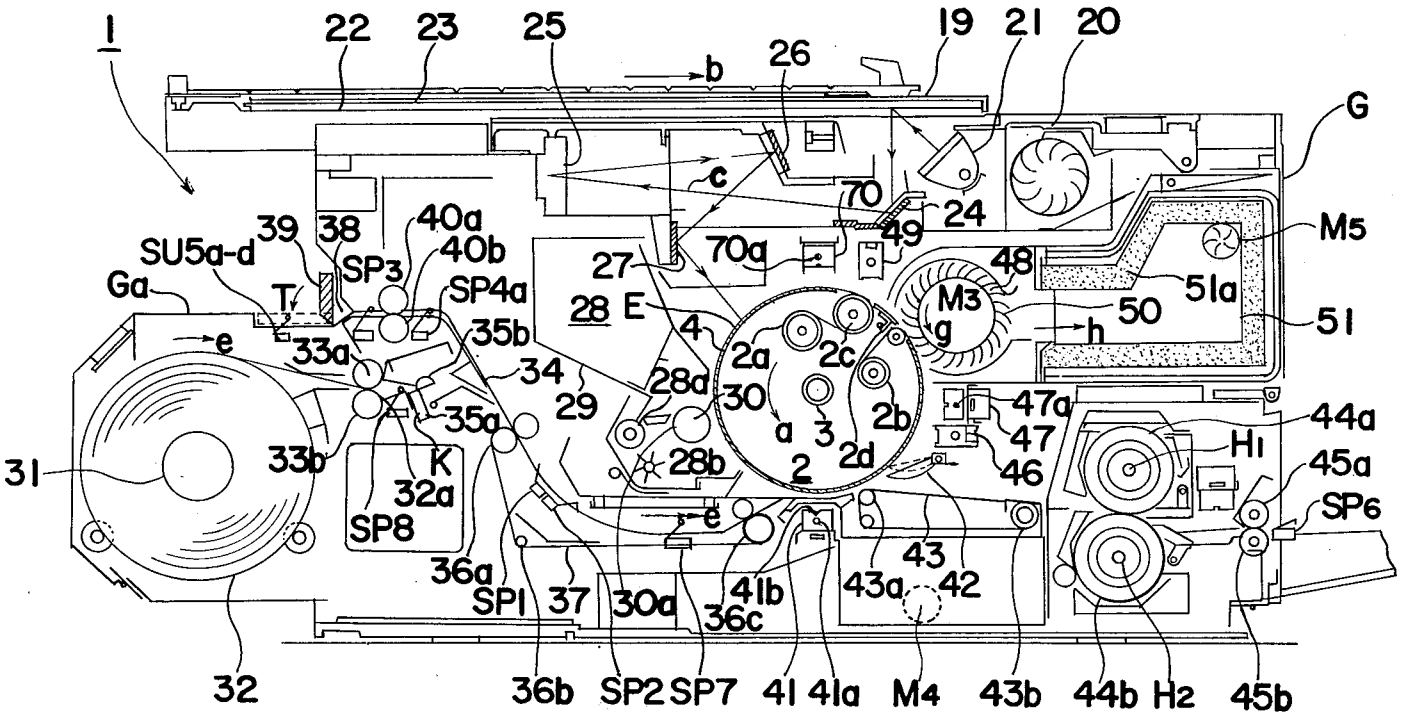
Figure 22:
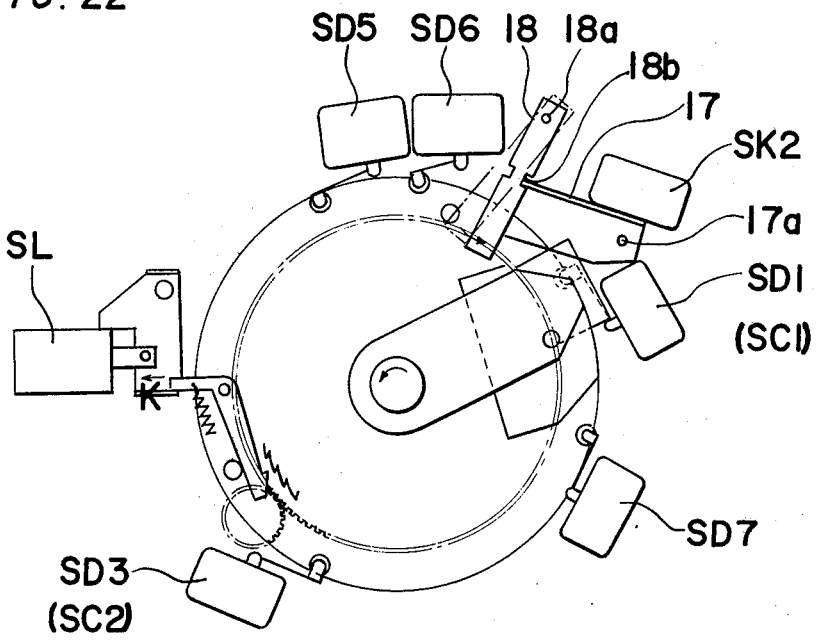
Figure 23:
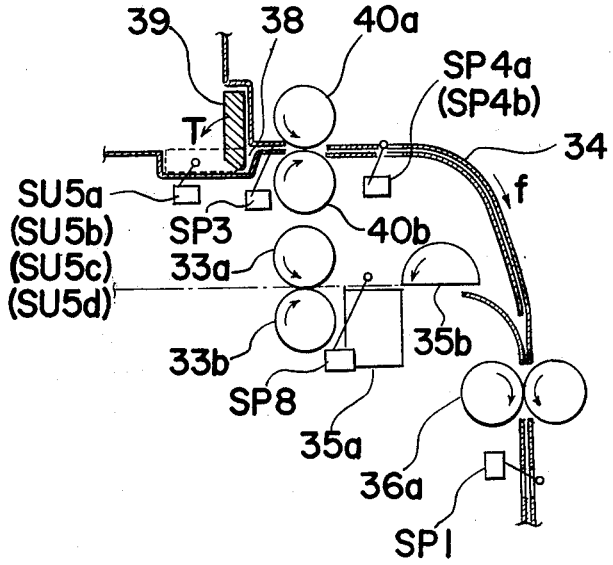
Figure 24:
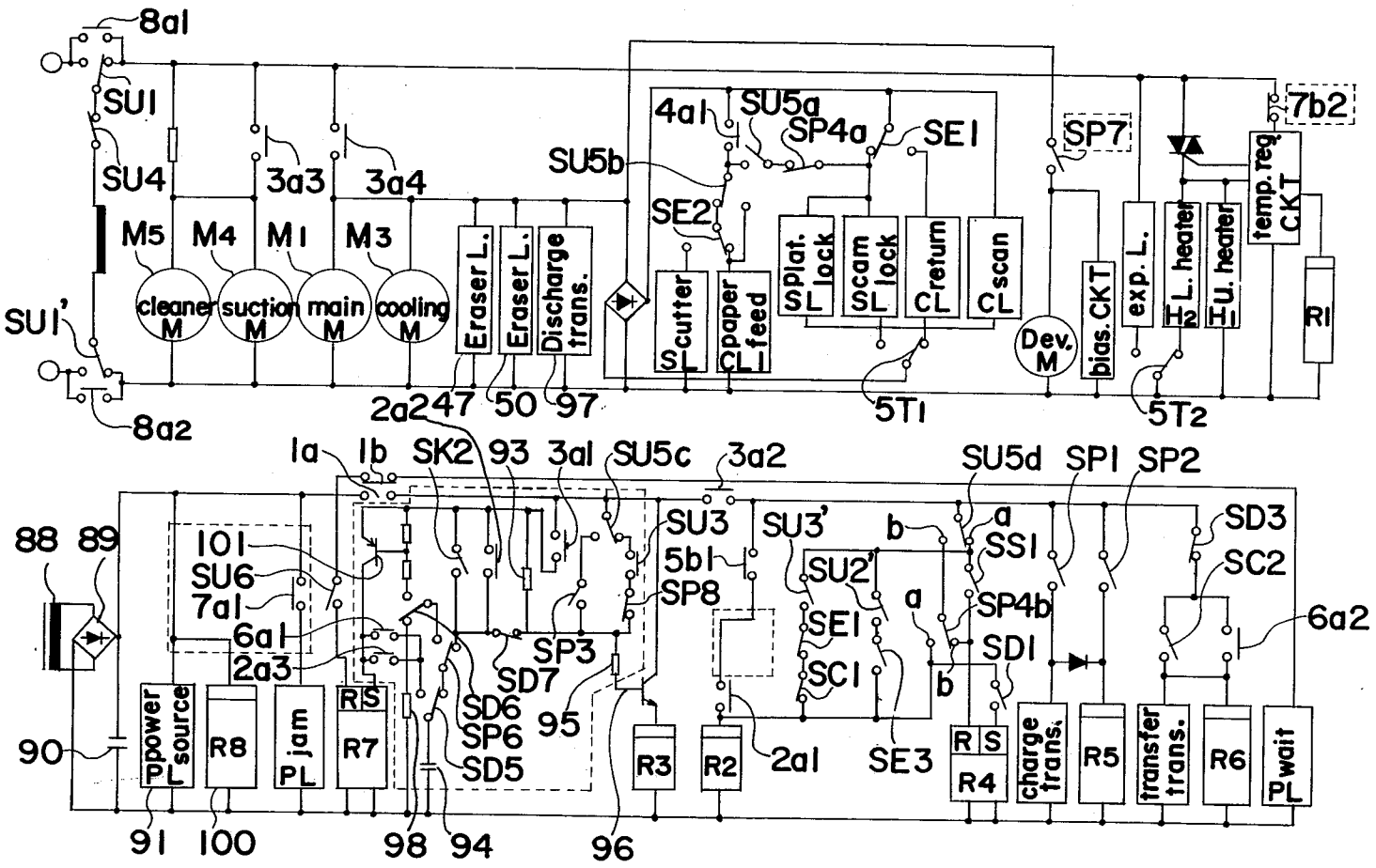
Figure 25:
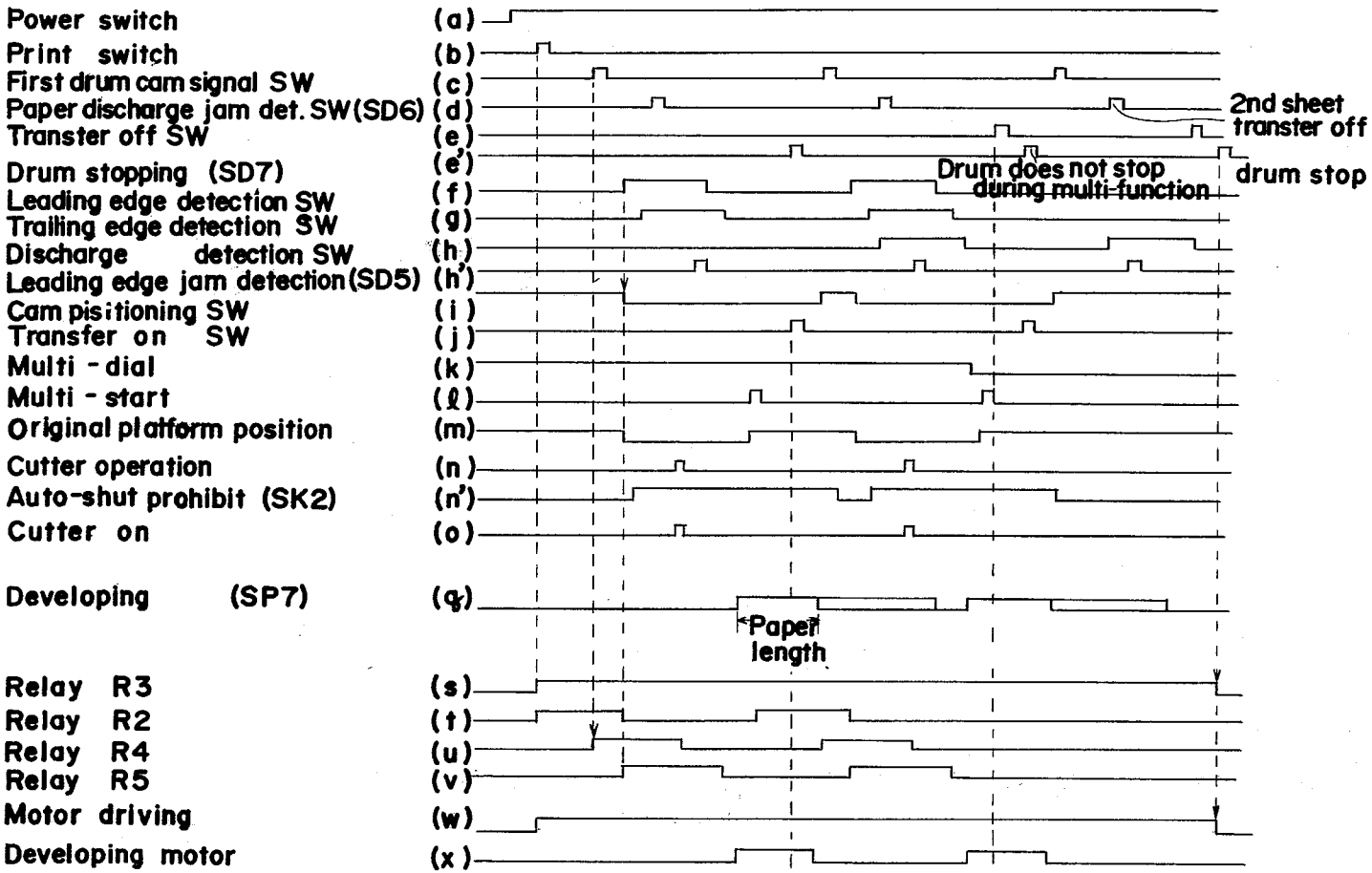

These and other objects and features of the present invention will become apparent from the following description taken in conjunction with the preferred embodiment thereof with reference to the attached drawings in which;

FIG. 1 is a schematic diagram showing a sectional side view of a transfer type electrophotographic copying apparatus according to one embodiment of the present invention, FIG. 2 is a schematic sectional view showing, on an enlarged scale, the arrangement of the photoreceptor drum and mechanisms associated therewith which is employed in the copying apparatus of FIG. 1, FIG. 3 is a schematic side elevational view of the photoreceptor drum and associated mechanisms of FIG. 2, FIG. 4 is a schematic sectional view, on an enlarged scale, of a copy paper manual insertion and feeding mechanism employed in the copying apparatus of FIG. 1, FIG. 5 is a schematic sectional view showing, on an enlarged scale, construction of a switch-over mechanism between manual insertion of the copy paper and feedng from the paper roll employed in the copying apparatus of FIG. 1, FIG. 6 is a schematic side view showing the switch-over mechanism of FIG. 5 arranged for feeding copy paper from the paper roll, FIG. 7 is a view similar to FIG. 6, but particularly shows the switch-over mechanism of FIG. 5 arranged for manual insertion and feeding of the copy paper, FIG. 8 is a fragmentary sectional view showing, on an enlarged scale, a modification of a residual charge erasing device employed in the copying apparatus of FIG. 1, FIG. 9 is a schematic diagram showing an arrangement of the driving mechanism employed in the copying apparatus of FIG. 1, FIG. 10 is an electrical circuit diagram showing the connections of the various components employed in the copying apparatus of FIG. 1, FIG. 11 is a timing chart showing the sequence of operation for the copying apparatus of FIG. 1, FIG. 12 is an electrical circuit diagram showing a modification of the power failure protection circuit employed in the circuit of FIG. 10, FIG. 13 is a schematic diagram showing the arrangement of one example of the developing biasing voltage timing control means employed in the copying apparatus of FIG. 1, FIG. 14 is an electrical circuit diagram showing the construction of the developing biasing voltage timing control means of FIG. 13, FIGS. 15 and 16 are fragmentary side elevational views, on enlarged scales, showing the arrangement of the cutting means and associated mechanisms employed in the copying apparatus of FIG. 1, FIG. 17 is a fragmentary sectional view of the cutter means and associated mechanism shown in FIGS. 15 and 16, FIGS. 18 and 19 are views similar to FIGS. 15 and 16, but particularly show a modification thereof, FIG. 20 is a fragmentary sectional view of the cutting means and associated mechanism shown in FIGS. 18 and 19, FIG. 21 is a view similar to FIG. 1, but particularly shows a modification thereof, FIG. 22 is a view similar to FIG. 3, but particularly shows a modification thereof, FIG. 23 is a view similar to FIG. 4, but particularly shows a modification thereof, FIG. 24 is a diagram similar to FIG. 10, but particularly shows a modification thereof, and FIG. 25 is a chart similar to FIG. 11, but particularly relates to the modification of FIG. 21.

Before the description of the present invention proceeds, it is to be noted that like parts are designated by like reference numerals throughout several views of the accompanying drawings.

Referring to FIGS. 1 to 20, there is shown in FIG. 1 a transfer type electrophotographic copying apparatus 1 of the invention which comprises a photoreceptor drum 2 having a photoreceptor surface or photoreceptor layer 4 on the outer periphery thereof and secured on a rotatable shaft 3 suitably journalled in the frame (not shown) of a housing G of the copying apparatus so as to rotate in the direction shown by the arrow "*a*" for causing the photoreceptor surface 4 to sequentially pass various processing stations such as a corona charging station provided with a corona charger 70, an exposure station E, a developing station having a developing device 28, a transfer and charging station with a transfer corona charger 41, a copy paper separating station provided with a separating claw 42, a residual charge erasing station having a first eraser lamp 46 and an erasing charger 47 and a cleaning station provided with a cleaning device 48 for removing residual toner from the photoreceptor surface 4, each of these stations is disposed along the path of the photoreceptor surface 4. On the upper portion of the apparatus housing G, there is a horizontally, reciprocating transparent platform 19 for placing an original 23 to be copied thereon. Light images of the original 23 illuminated by an exposure lamp 21 are directed through reflecting mirrors 24, 25, 26 and 27 as shown by the arrowed line c onto the photoreceptor surface 4 at the exposure station E.

The photoreceptor drum 2 includes the photoreceptor 4 in sheet-like form stored on a supply roll 2*a* housed within the drum 2 and led therefrom around the outer periphery of the same drum 2 via an idle roller 2*c* and through a slot 2*d* axially formed in the drum surface so as to be wound onto a takeup roll 2*b* also housed within the drum 2. This enables the photoreceptor 4 on the drum 2 to be replaced when wound onto the takeup roll 2*b*. It is needless to say that the photoreceptor 4 may be modified to be wound around the outer periphery of the drum 2 and tightly held thereon with the opposite edges thereof fixed by an electrically conductive tape (not shown) or the like.

Referring particularly to FIGS. 2 and 3, the drum shaft 3 has its end portion 3*a* extending from the photoreceptor drum 2. On this end portion 3*a*, a drum driving gear 5 and a drum cam 6 are fixedly mounted in a spaced relation to each other. A gear 7 coupled to a main motor (not shown) through a transmission means engages the drum driving gear 5 for rotating the drum 2, the drum shaft 3 and the drum cam 6 simultaneously as one unit. As the drum cam 6 rotates, switches SD1, SD2, SD3, SD4, and SD5 disposed around the outer periphery of the drum 2 are sequentially actuated in a manner mentioned later. On the shaft 3 in a position between the drum driving gear 5 and the drum cam 6, there is rotatably mounted a control cam driving gear 8, with a control cam 9 frictionally contacting said gear 8. The gear 8 is driven by a gear 10 through a transmission mechanism (not shown) independent of the shaft 3 and rotates the control cam 9 for actuating switches SC1 and SC2 disposed in the path of control cam 9. On one surface adjacent to the outer periphery of the control cam 9 and facing the drum cam 6, there are fixedly mounted a separating claw lever 9*a*, a switch actuating plate 9*b* through a shaft 11 and a latch actuating pin 9*c* (FIG. 3). On while on the other surface adjacent to the outer periphery of the control cam 9 and facing the control cam driving gear 8, there is pivotally disposed through a pin 12*a* a control cam restricting lever 12 of approximately L shape in a position confronting the separating claw lever 9*a* of the control cam 9, with the drum shaft 3 being located therebetween. A spring 13 is connected between one end 12*b* of the control cam restricting lever 12 and the control cam 9 for urging the lever 12 counterclockwise (as viewed in FIG. 3). The end 12*b* of the lever 12 normally engages an engaging portion 15*a* extending in a direction parallel to the drum shaft 3 from an engaging lever 15 secured to a plunger of a solenoid 14 which is disposed in the vicinity of the outer periphery of the control cam driving gear 8. In this state, since a latch gear 16 integrally formed with the gear 8 is disengaged from a latch portion 12*c* at the other end of the control cam restricting lever 12, the control cam 9 remains stationary at an initial stage. When the solenoid 14 is energized, the engaging lever 15 is displaced in the direction of the arrow K, the engaging portion 15*a* of the lever 15 is disengaged from the end 12*b* of the control cam restricting lever 12, and the lever 12 rotates counterclockwise by the urging force of the spring 13, whereby the latch portion 12*c* of the lever 12 engages the latch gear 16 for positively transmitting the rotation of the driving gear 8 to the control cam 9. As is clear from FIG. 3, if solenoid 14 is denergized when control cam 9 completes one revolution, then the end 12*b* of restricting level 12 engages the engaging portion 15*a* of lever 15 which disengages latch portion 12c from latch gear 16. Thus the control cam 9 is no longer rotated by driving gear 8.

Still referring to FIGS. 2 and 3, in a position above the control cam restricting lever 12, an operating lever 17 for actuating a developing device operating switch SK1 is pivotally supported through a pin 17a by the frame of the copying apparatus. A supporting lever 18 for holding the operating lever 17 in a predetermined position is also supported by the frame through a pin 18a. The levers 17 and 18 are normally forced by spring means (not shown) in directions shown by arrows R and S respectively, with the lever 17 being located in a position shown by the dashed line, while the lever 18 is positioned as indicated by the solid line. When the switch actuating plate 9b contacts the operating lever 17 as the control cam 9 rotates, the operating lever 17 rotates clockwise, and an engaging portion 17b extending at right angles from one edge of the lever 17 in a direction parallel to the shaft 3 engages at the lower edge thereof with a notch 18b formed in the central portion of the supporting lever 18 so as to hold the operating lever 17 in a position indicated by the solid line for maintaining the latch switch SK1 in the on state. Meanwhile, a pin 6a secured to the surface of the drum cam 6 opposite the control cam 9 engages the other end of the supporting lever 18 through rotation of the drum cam 6 for rotating the lever 18 clockwise to a position shown by the dashed line. This releases the operating lever 17 which returns to the original position shown by the dashed line to turn off the latch switch SK1.

Referring back to FIG. 1, in a position above the photoreceptor drum 2, there is disposed the corona charger 70 having a wire electrode 70a disposed in a stabilizing plate for imparting a negative charge to the photoreceptor 4. An exposure lamp 21 is suitably cooled by a cooling fan 20 and fixedly disposed below the transparent platform 19. Light rays C from the exposure lamp 21 are directed to a predetermined position of the platform 19 which moves in the direction of the arrow "b" at a speed equal to the rotational speed of the photoreceptor drum 2, and are projected onto the original 23 placed on the surface of a light transmitting plate 22 of the platform 19. The light rays "c" reflected from the original 23 are then directed onto the photoreceptor surface 4 through the reflecting mirror 24, the mirror lens assembly 25, the reflecting mirrors 26 and 27 which are suitably inclined for the formation of the image of the original 23 on the photoreceptor surface 4. Since the magnification of the mirror lens assembly 25 is to be one, the image to be formed on the photoreceptor surface 4 is equal in size to the original 23. On the photoreceptor surface 4, the negative charge is erased at the portions where the light intensity from the mirror 27 is high, i.e., where the density of the original 23 is low, while the same negative charge remains only at the portion where the light intensity from the mirror 27 is low, i.e., where the density of the original 23 is high. Thus an electrostatic latent image of the original 23 is formed on the photoreceptor surface 4.

In FIG. 1, the developing device 28 disposed at the left hand side of the photoreceptor drum 2 includes a toner tank 29, a toner supplying roller (not shown), a developing material diffusing roller 28a, a developing material stirring roller 28b, and a developing or magnetic roller 30 having a rotatable outer cylinder 30a of weak magnetizable material and stationary magnets (not shown) incorporated in the cylinder 30a which is disposed adjacent to the drum 2 in spaced relation to the drum 2. The toner particles housed in the toner tank 29 are supplied at a predetermined rate into the magnetizable carrier material such as iron filings or the like to form the developing material in which the toner particles are triboelectrically charged to 'positive' by the carrier material through rotation of the rollers 28a and 28b. The developing material including the toner particles thus charged to 'positive' polarity form magnetic brush bristles on the outer cylinder 30a. As the cylinder 30a rotates, the toner particles adhere to the portion of the photoreceptor surface 4 which is negatively charged for developing the electrostatic latent image into a visible toner powder image. It should be noted here that the developing device 28 is further provided with biasing voltage timing control means for charging only the latent image forming portion, without charging the non-latent image forming portion of the photoreceptor 4, by arranging the corona charger 70 to be turned on or off depending on the length of copy paper. More specifically, the biasing voltage means for applying a developing bias having the same polarity as the latent image to the toner particles is adapted to be variable for variation of biasing voltage at the image formed portion and the non-image formed portion through a change-over means associated with the copying operation for preventing the toner particles from adhering to the non-image formed portion. For the above described purpose, in FIG. 1, the corona charger 70 is, for example, formed into slit-like configuration at its discharge opening (not shown), with a shutter member (not shown) which moves in association with the copying operation being pivotally disposed between the discharge opening and the photoreceptor surface 4 for selectively opening and closing the discharge opening of the corona charger 70 by the operation of the shutter member so as to control the charged length on the photoreceptor surface 4. The magnetic roller 30 is provided with a variable bias applying means mentioned later. Thus only the image forming portion of the photoreceptor surface 4 of the drum 2 rotating counterclockwise is charged in the region −700 to 31 800 V by the corona charger 70, without charging the non-image forming portion of the same photoreceptor surface 4.

It is to be noted that the concept of the above described arrangement for preventing toner from adhering to the non-image forming portion is not limited in its application to magnetic brush developing, but may be applicable to the known cascade developing, in which case, the biasing voltage to be applied to a developing electrode opposite the photoreceptor surface 4 may be adapted to be variable.

In the foregoing arrangement, the degree of variation of the biasing voltage is determined taking into account the physical properties of the toner and the photoreceptor in order not to impart a coulomb force contributing to adhesion therebetween due to the potential of the non-image forming portion (such potential may generally be regarded as zero). One example of circuit construction for the above described biasing voltage control means for charging only the latent image forming portion, without charging the non-latent image forming portion of the photoreceptor will be described in more detail later with reference to FIGS. 13 and 14.

Still referring to FIG. 1, at the left hand side of the apparatus housing G, there is rotatably disposed a spindle 31 on which copy paper 32 is wound in a roll form. The leading edge 32a of copy paper 32 is held between a pair of copy paper feeding rollers 33a and 33b, and the copy paper 32 from the roll is fed in the direction of the arrow "e" at the same speed as the circumferential speed of the photoreceptor drum 4 as the rollers 33a and 33b are rotated. A guide plate 34 extending downward is disposed along the transportation path of the copy paper 32, with cutter means K which has blades member 35a and 35b being provided between the rollers 33a and 33b and the guide plate 34. Along the guide plate 34 curving downwardly toward the photoreceptor drum 4, three transportation rollers 36a, 36b and 36c are disposed to form an approximately triangular path, with a belt 37 being directed at proper tension around the roller pairs 36a, 36b and 36c for transporting the copy paper 32 in the direction of the arrow "e" between the belt 37 and the guide plate 34. On the path of the copy paper 32 along the guide plate 34 and between the roller 36a and 36b, a leading edge detection switch SP1 and a trailing edge detection switch SP2 properly spaced from each other are disposed. As the copy paper 32 is fed through the guide plate 34 and the roller pairs 33, 36a, and 36c toward the transfer station provided with the corona charger 41, the copy paper 32 is cut to a predetermined size by the cutter means K having a rotatory blade 35b and a stationary blade 35a.

Referring also to FIG. 4, there is shown a manual copy paper sheet insertion and feeding mechanism provided above the copy paper roll 32, in which mechanism, a manual insertion cover plate 39 mentioned in greater detail later is pivotally disposed at an insertion opening 38 which is formed close to one end of the guide plate 34 adjacent to a pair of rollers 40a and 40b. The cover plate 39 normally located in a position shown by the solid line and closing the insertion opening 38 is rotated counterclockwise in the direction of the arrow T into a position shown by the dashed line so as to serve as a copy paper insertion plate for manual insertion of the copy paper sheet, whereby manual insertion cover switches SU5a, SU5b, SU5c and SU5d disposed in suitable positions are actuated, with the insertion opening 38 opened. The copy paper sheet inserted through the opening 38 is transported along the guide plate 34 in the direction of the arrow "f" as the rollers 40a and 40b rotate. On opposite sides of the pair of rollers 40a and 40b, there are disposed, along the guide plate 34, a manual insertion detection switch SP3 and temporary suspension switches SP4a and SP4b which are actuated upon passage of the copy paper sheet.

For the switch-over between the manual copy paper insertion and the automatic copy paper feed from the paper roll 32, there is further provided, in the copying apparatus of the invention, a copy paper feed switch-over mechanism as described hereinbelow. The feed switch-over mechanism is of a simple construction in which the output portion of a clutch mechanism operated by one solenoid is selectively connected to the roll paper feeding rollers or the copy paper sheet feeding rollers.

Referring to FIGS. 5 to 7 showing detailed construction of the copy paper feed switch-over mechanism, a sprocket 113 is rotatably mounted on a clutch shaft 115 through a bearing 114, while the clutch shaft 115 is rotatably supported by supporting frames 116a and 116b through bearings 117a and 117b. A sprocket 118 secured to the driving shaft 36c of the roller 36a is connected to the sprocket 113 through a chain 119 (FIG. 6). Upon transmission of rotational force to the driving shaft 36c from a driving source (not shown), the transportation rollers 36a and the sprocket 113 are rotated. Further secured to the clutch shaft 115 are a clutch drum 120 and a clutch gear 121. On the outer periphery of the clutch drum 120, a sleeve 123 is rotatably mounted through a bearing 122, while a clutch spring 124 is spirally wound in the same direction as that of the rotation of the sprocket 113, with one end of the spring 124 being fixed to a boss portion of the sprocket 113 and with the other end of the spring 124 secured to an end face of the sleeve 123. A solenoid 125 is fixed to the supporting frames 116a and 116b through brackets (not shown), and a projection 128 secured to the outer periphery of a brake ring 127 which is rotatably mounted on the sleeve 123 is connected to the end of a plunger 126 of the solenoid 125. The gear mounting plate 129, rotatably mounted on the boss portion of the clutch gear 121 and a pivotal portion 116c of the supporting frame 116b, has an arm portion 129a extending sidewise therefrom. The arm portion 129a has supporting shafts 130a and 130b secured thereto, on which idle gears 132a and 132b are rotatably mounted through bearings 131a and 131b. The gears 132a and 132b mesh with each other, while the gear 132a also engages the clutch gear 121. The gear mounting plate 129 is rotatable about the clutch shaft 115 within the range in which its arm portion 129c extending upwardly contacts either a stopper 133a or a stopper 133b (FIG. 6). On the locus of upward and downward movement of the gear 132b, a gear 134 fixed to the same shaft as the roll copy paper feeding roller 33a and a gear 135 fixed to the same shaft as the copy paper sheet feeding roller 40a are disposed. The gear 132b selectively engages the gears 134 or 135, following the movement of the gear mounting plate 129 in a manner as described below. Meanwhile, the stoppers 133a and 133b are so arranged as to restrict the movement of the mounting plate 129 within such a range that when the gear 132b engages the gears 134 and 135, they correctly engage, with their pitch circles being tangent to each other.

On the other hand, the manual insertion cover plate or copy paper insertion plate 39 is fixed to a shaft 39a pivoted to the supporting frame 116b together with a switch-over plate 138, and can be rotated between the raised position and the lower position about the shaft 39a. In the raised position, the plate 39 closes the copy paper insertion opening 38 (FIG. 1), while the plate 39 forms a copy paper sheet insertion mount together with the surface Ga (FIG. 1) of the apparatus housing G in the lowered position.

Meanwhile, on the shaft 130b of the gear 132b, a gear engaging plate 139 is rotatably mounted. One end of a spring 140 is wound around the boss portion of the plate 139 and connected to a pin 141 fixed to one side of the plate 139 itself. The other end of the spring 140 is connected to a projection 129b provided at the end of the arm portion 129a of the gear mounting plate 129 mentioned earlier. The gear engaging plate 139 is normally urged counterclockwise about the shaft 130b by the restoring force of a spring 142 and is restricted from further rotation by contact of the side portion thereof with the projection 129b. Moreover, the shaft 130b is normally urged downward (FIGS. 6 and 7) by the contact thereof with a central portion of a depressing spring 140, which is connected at one end 140a thereof to the apparatus housing, with the other end 140b of the spring 140 extending under the lower portion of the switch-over plate 138. A lock plate 143 is pivotally disposed by a pin 144 secured to the supporting frame 116a, and a projection 143a formed at one end of the plate 143 engages a pin 126*a* provided at the outer periphery of the plunger 126 of the solenoid 125. The other end 143*b* of the plate 143 is located under the switch-over plate 138. Thus the plate 143 is rotatable about the pin 144, following the movement of the plunger 126 by the turning on or off of the solenoid 125.

By the above arrangement, when the copy paper is to be fed from the paper roll 32 of FIG. 1 (FIG. 6), the manual insertion cover plate 39 is manually rotated to the raised position, with the switch-over plate 138 being simultaneously rotated clockwise for depressing the end 140*b* of the depression spring 140 by the side piece 138*a* of the plate 138. Accordingly, the gear mounting plate 129 engaging the spring 140 through the shaft 130*b* rotates counterclockwise to a certain extent about the clutch shaft 115 until the arm portion 129*c* thereof contacts the stopper 133*a*, with the gear 132*b* being engaged with the gear 134. Upon turning on of a print switch (not shown), copying operations such as charging, exposure, etc., are started, while the driving source (not shown) is energized to rotate the rollers 36*a* (FIG. 1), and the sprocket 118 whose rotation is transmitted to the sprocket 113 through the chain 119. The rotation of the sprocket 113 is transmitted to the sleeve 123 through the clutch spring 124 for idle rotation of the sleeve 123. In this state, when the copy paper feeding signal is given the solenoid 125 is energized, the plunger 126 of the solenoid 125 is retracted and an inner surface 127*a* of a brake ring 127 contacts, under pressure, the outer periphery of the sleeve 123 for braking the rotation of the sleeve 123, while the lock plate 143 engaging the pin 126*a* of the plunger 126 is rotated clockwise to a certain extent about the pin 144, with the end 143*b* of the plate 143 entering the locus of rotation of the side piece 138*a* of the switch-over plate 138 for preventing the switch-over plate 138 and consequently the cover plate 39 from being rotated to the lowered position (locking). As the sprocket 113 continues to rotate despite the braking of the sleeve 123 by the brake ring 127, the clutch spring 124 is pressed against the outer periphery of the clutch drum 120 for transmitting the rotational force to the clutch drum 120, and finally the sleeve 123 rotates with the clutch drum 120 through the clutch spring 124. The rotation of the clutch drum 120 is transmitted to the clutch gear 121 through the clutch shaft 115 and further to the gear 134 via the gears 132*a* and 132*b* for rotating the roll paper feeding rollers 33*a* and 33*b* (FIG. 1) to feed the copy paper from the roll 32. Upon completion of the copy paper feeding, the solenoid 125 is turned off by a completion signal, and the plunger 126 is advanced for releasing the brake ring 127 from the sleeve 123, while the lock plate 143 rotates counterclockwise by its weight, and the switch-over plate 138 is released from locking by the end 143*b* of the plate 143.

On the other hand, when the copy paper sheet is to be fed through manual insertion (FIG. 7), the cover plate 39 in the raised position is rotated to the lowered position, by which rotation, the switch-over plate 138 is rotated counterclockwise. The spring 140 is released from the depression by the side piece 138*a* of the plate 138. The side piece 138*b* contacts the under side of the gear engaging plate 139 for rotating the plate 139 clockwise to a certain extend about the shaft 130*b*. Following the rotation of the plate 139, the gear mounting plate 129 is rotated clockwise to a certain extent about the clutch shaft 115 until the arm portion 129*c* thereof contacts the stopper 133*b* by the spring force of the spring 142, and thus the gear 132*b* engages the gear 135. Thereafter, when the print switch (not shown) is turned on, the rotation of the sprocket 118 is transmitted from the gear 132*b* to the gear 135 for rotating the copy paper sheet feeding rollers 40*a* and 40*b* to feed the copy paper in the sheet form.

Referring back to FIG. 1, the transfer charger 41 disposed at the transfer and charging station below the photoreceptor drum 2 and extending the axial direction of the drum 2 has a construction similar to that of the corona charger 70 mentioned earlier, with a negative high voltage being impressed to a wire electrode 41*a* enclosed therein, the negative high voltage of the wire electrode 41*a* causes the toner particles adhering to the photoreceptor surface 4 of the photoreceptor drum 2 to be sequentially attracted onto the copy paper sheet transported under the drum 2. The copy paper sheet onto which the toner particles are thus transferred is subsequently separated from the photoreceptor surface 4 as the separating claw 42 disposed adjacent to the drum 2 is pivoted clockwise into a position shown by the dashed line and placed on a transportation belt 43 supported by transportation rollers 43*a* and 43*b* to move in the same direction as that of the belt 37 earlier mentioned. The transportation belt 43 has a plurality of suction openings (not shown) uniformly formed in its entire surface, through which openings, suction force caused by a fan motor M4 which is disposed below the belt 43 is exerted on the copy paper sheet for transporting the copy paper sheet attracted onto the surface of the belt 43 in a direction of the arrow "*e*" as the belt 43 moves. In a suitable position adjacent to the belt 43, there is disposed a sheet separation detection switch SP5 for detecting the presence of the copy paper sheet after the separation.

At the right hand side of the transportation belt 43 in FIG. 1, there are rotatably disposed a pair of fixing rollers 44*a* and 44*b*, each of which has a metallic core covered with a layer of silicone rubber or the like to form the surface, and is provided therein with a heating element H1 or H2 to maintain its surface at a predetermined temperature. When the copy paper sheet having the toner particles adhering thereto passes between the fixing rollers 44*a* and 44*b*, the toner particles are fused onto the copy paper sheet by the heat of the rollers 44*a* and 44*b*. The copy paper sheet having the toner particles thus fused thereonto is discharged out of the apparatus housing G through another pair of discharge rollers 45*a* and 45*b* rotatably disposed subsequent to the fixing rollers 44*a* and 44*b*, while being detected by the discharge detection switch SP6 provided adjacent to the rollers 45*a* and 45*b*.

Additionally, in the above described transfer and charging device wherein the toner image formed on the photoreceptor is transferred onto the copy paper sheet while the corona charge is applied to the copy paper sheet from the reverse side thereof by the transfer and charging device 41, a special method is employed as described hereinbelow for controlling the function of said transfer and charging device for eliminating the disadvantages inherent in the conventional transfer and charging devices, in which various problems are involved in the copy paper separation due to strong electrostatic attraction of the entire copy paper sheet onto the photoreceptor surface, because of the arrangement that the transfer and charging device is actuated before the arrival of the copy paper sheet at the transfer position for uniformly imparting charge onto the entire copy paper sheet.

Still referring to FIG. 1, the microswitch SP1 disposed along the passage of the copy paper between the rollers 36*a* and 36*b* is adapted to cause a copying operation control cam plate (not shown) to rotate upon being turned on by the leading edge of the copy paper, while the transfer corona charger 41 which applies charge to the copy paper from the reverse side thereof is connected to a high voltage source (not shown) by signals produced through rotation of said cam plate (not shown). The separating claw 42 is also selectively brought into engagement with and spaced from the photoreceptor 4 by the rotation of said cam plate (not shown) and is controlled to contact the photoreceptor surface 4 only during separation of the copy paper therefrom. Upon initiation of the copying operation, the copy paper is transported in a manner described earlier in the direction shown by the arrow "*e*" and turns on the microswitch SP1 at its leading edge to cause the rotation of the copying operation control cam mentioned above. In synchronization with the arrival of the leading edge of the copy paper at a position immediately above the wire electrode 41*a* of the transfer charger 41 under the photoreceptor drum 2 in FIG. 1, the transfer charger operation starting signal is emitted through the rotation of the cam plate (a switch SC2 mentioned later is turned on), with the transfer charger 41 being actuated by connection to the high voltage source (not shown). Therefore, as compared with the conventional arrangements wherein the transfer and charging device is actuated prior to the arrival of the copy paper at the transfer position for uniformly charging the entire copy paper, the operation control method of the transfer and charging device of this invention, in which the transfer and charging device is actuated at the point as described above, the charging action of the transfer charger 41 at the leading edge of the copy paper is extremely weak in comparison with the portion of the copy paper after its leading edge, thus electrostatic attraction of the copy paper toward the photoreceptor surface 4 at the leading edge thereof is sufficiently reduced, and the toner image on the photoreceptor surface 4 is hardly transferred onto the copy paper at said leading edge portion. In synchronization with the arrival of the leading edge of the copy paper at the copy paper separating station while the copy paper is being transported, with said leading edge lying on the photoreceptor surface 4, a separating claw actuation signal is transmitted through rotation of the above mentioned cam plate for pressing the tip of the claw 42 against the photoreceptor surface 4, and the leading edge of the copy paper is separated from the photoreceptor surface 4 by the claw 42. The copy paper thus separated from the drum 2 is attracted onto the suction belt 43 to be transported toward the subsequent processing device. It should be noted here that in the above described separation, since the leading edge of the copy paper is attracted onto the photoreceptor surface 4 with extremely weak electrostatic attraction as mentioned above, the copy paper sheet may be arranged to be separated from the drum 2 by the radius of curvature of the drum 2 and suction force of the belt 43 only, in which case the separating claw 42 may be dispensed with. After the trailing edge of the copy paper sheet has passed the transfer charger 41, a transfer charger operation stopping signal is emitted through said cam plate for disconnecting the transfer charger 41 from the high voltage source (not shown). It is also to be noted that in the foregoing embodiment, the operation control for the transfer charger 41 described as effected by the connection and disconnection of the charger 41 with respect to the high voltage source may be modified to be effected, for example, by providing a shutter plate member (not shown) disposed at the opening 41*b* (FIG. 1) of the transfer charger 41 and suitably associated with a solenoid (not shown) for sliding movement thereof for adjusting the width of the opening 41*b*. Additionally, although the transfer and charging device is mainly described with reference to the transfer charger 41, such transfer and charging device is not limited to the transfer charger 41, but other types of transfer and charging devices, for example, one of the types wherein an electrode roller (not shown) impressing charge onto the copy paper sheet from the reverse side thereof while pressing the copy paper sheet against the photoreceptor surface 4 may be employed.

Still referring to FIG. 1, above the separating claw 42, there are disposed a residual charge erasing device having a first eraser lamp 46 a charge erasing charger 47, and a cleaning device 48, while a second erasing lamp 49 is disposed between the cleaning device 48 and the corona charger 70 for removing the triboelectrical charge caused by a cleaner brush 50 of the cleaning device 48. An A.C. voltage is impressed to a wire electrode 47*a* of the charge erasing charger 47 for erasing negative charge which can not be fully erased by the first eraser lamp 46 so as to remove electrical attraction between the toner particles and the photoreceptor surface 4. The cleaning device 48 comprises the brush 50 having brush bristles, for example, of rabbit hair and rotated at high speed in a direction shown by the arrow "*g*", and a filter bag 51 which includes a filter 51*a* having numerous openings (not shown) each smaller in diameter than that of the particles and a cleaner motor M5 disposed in the filter bag 51 for drawing in the air in the direction of the arrow "*h*".

Referring now to FIG. 8, there is shown a modification of the residual charge erasing device illustrated in FIG. 1 described above. This modification is aimed at reducing the size of the residual charge erasing device and consequently the room occupied by the device in the copying apparatus through simple construction. The first eraser lamp 46 and the charge erasing charger 47 described as employed in the residual charge erasing device of FIG. 1 are replaced by a charge eraser 47A including a housing or lamp cover *h*, an erasing lamp *l* housed in the housing *h*, a dust preventing filter plate *f* of light transmitting and electrically insulating material such as acrylic resin which is mounted on an opening of the housing *h* facing the photoreceptor surface 4, and an A.C. corona charge generating charge wire *w* accommodated, for example, in a groove *d* formed in the central portion of the filter plate *f*. Although the charge wire 47*a* of the charge erasing charger 47 of FIG. 1 is surrounded by a stabilizing plate (not shown), such stabilizing plate is not necessarily required in the case of an A.C. corona discharge, and it has been experimentally confirmed by the present inventors that the construction of the above described modification is sufficient to fully erase the residual charge.

Referring also to FIG. 9, a driving system for the copying apparatus of FIG. 1 is described hereinbelow.

Upon rotation of a gear 52 by a main motor M1, a gear 53 fixed to a shaft of a copy paper feeding clutch CL1, a gear 54 secured to a shaft of a scan clutch CL2, a gear 55 fixed to a shaft of a return clutch CL3, a gear 5 secured to the shaft 3 of the photoreceptor drum 2

(gear 7 etc, for a transmission mechanism abbreviated for brevity), a gear 56 fixed to a shaft of the transportation roller 36c, and a gear 57 secured to a shaft of the transportation roller 43b are rotated through a chain directed therearound. The rotation of the gear 53 is transmitted to a gear 58 fixed to a shaft of the feeding roller 33b through a gear 59 fixed to a shaft of the fixing roller 44b when the feeding clutch CL1 is energized, while in the manual insertion of the copy paper sheet, the rotation of the gear 53 is transmitted through a gear 59 to a gear 60 secured to the shaft of the roller 40b. Meanwhile, when the scan clutch CL2 is energized, the rotation of the gear 53 is transmitted to a rack (not shown) secured to the platform 19 to drive the platform 19 in the direction of the arrow "*b*" of FIG. 1. When the return clutch CL3 is energized, the rotation of the gear 55 is transmitted to the rack of the platform 19 to drive the platform 19 in the direction opposite to the above direction.

A chain is directed over the gear 57 secured to the transporting roller 43b and a gear 61 secured to the shaft of the discharging roller 45b for transmitting rotation.

The rotation of the gear 7 for driving the drum shaft 3 is transmitted to the gear 10 (FIGS. 2 and 3) and the control cam driving gear 8 (FIGS. 2 and 3) is rotated in a rotation period slightly shorter than the rotation period of the photoreceptor drum 2, the rate of which is determined by the difference in the number of teeth of the gears.

The rotation of the gear 62 secured to a rotary shaft of a developing motor M2 is transmitted to a gear 64 which in turn rotates a gear 63 secured to a shaft of the outer cylinder 30a, a roller for supplying toner (not shown), the roller 28a for diffusing developing material, and the impeller 28b for stirring developing material (FIG. 1).

A shaft of a cooling motor M3 is secured directly to a cooling fan 20 (FIG. 1) for rotating the latter, while the rotation of a gear 64 provided on the cleaner motor M3 is transmitted, through a belt 15, to a gear 66 for the brush 50.

FIG. 10 shows a control circuit for controlling each mechanism of the copying apparatus of FIG. 1. The control circuit is composed of a power source circuit 80, a temperature regulating circuit 81 for controlling to a predetermined temperature the heaters H1 and H2 which heat the fixing rollers 44a and 44b, a power failure protection circuit 82 for effecting copying operation successfully after the power failure, an auto-shutter circuit 83 for controlling power supply only during the copying operation, a manual copy paper insertion driving circuit 84 for effecting copying onto copy paper sheet, and a jam detecting circuit 85 for detecting paper cloggings caused during copying process.

Referring also to FIG. 11, the operation of the copying apparatus having the circuit construction as described above will be described hereinbelow.

First, the original 23 of a desired size is placed on the glass face 22 of the platform 19. When power switches SU1 and SU1' are turned on (FIG. 11(*a*)), current is caused to flow in the control circuit (shown in the lower portion of FIG. 10) through a transformer 88 (having a primary winding 88a and a secondary winding 88b), and a relay 8 is turned on to close contacts 8a1 and 8a2 for self-retaining so that the power is supplied to the entire circuit. Thus, heating voltage (FIG. 11, (r) and (el)) is applied directly to the upper heater H1 from a control circuit 86 of the temperature regulating circuit 81. A firing pulse is applied to a triac 87 which effects the phase control of the heating voltage of the lower heater H2 to heat the heaters H1 and H2 to a predetermined temperature. Meanwhile, the low voltage on the secondary winding 88b causes a power supply indication lamp 91 and a stand-by indication lamp 92 to be lit through a full-wave rectifier 89 and a smoothing capacitor 90 respectively.

When the temperature of the heater H1 goes over a predetermined temperature, a relay R1 is actuated to open a normally-closed contact 1b so as to turn off the wait lamp 92 and to close a normally-opened contact 1a.

Under the above condition, a multi-dial (not shown) provided in a suitable location of the copying apparatus 1 may be operated to set (FIG. 11(*k*)) the dial so that "2" may be indicated, for example, to effect two sheet copying continuously. Thus, a multi-dial switch SU2 is switched from a contact "*b*" to a contact "*a*", which a switch SU2' is closed and a capacitor 94 which was charged through a resistor 93 is kept charged through resistor 95.

In the above case, the platform 19 is located in a predetermined position. Switches SE1, SE1', SE1'', SE1''' for detecting the positions of the platform 19 are set as shown. Meanwhile, the control cam 9 is also located in a predetermined position, with the switches SE1', SE1''' and SC1 being in closed positions respectively as shown.

Upon turning-on of print switches SU3 and SU3' (FIG.11(*b*)), the switch SU3 closed causes the power to be applied to the base of a transistor 96 through the resistor 93 and the switch SU3. The transistor 96 is thus turned on to excite a relay R3 with a normally-open contact 3a1 thereof being closed to self-retain the relay R3 through transistor 96 (FIG. 11(s)). Through the excitation of the relay R3, the normally-open contact 3a2 is closed to supply the power to subsequent stages of the circuit. On the other hand the normally-open contacts 3a3 and 3a4 are closed to operate the main driving motor M1, the cooling motor M3, the eraser lamps 47 and 50, and an erasing charger driving transformer 97, to accelerate the rotation of the suction motor M4 and the cleaner motor M5 (FIG. 11(w)) with, and with to supply power to the full-wave rectifier 92 for driving the clutch mechanism. Closure of the switch SU3' excites the relay R2 to close the normally-open contact 2a1 for self-retaining the relay R2 (FIG. 11(t)). Upon operation of the main driving motor M1, the photoreceptor drum 2 and the drum cam 6 start rotation. First, the drum cam 6 closes (FIG. 11(*c*)) a first drum signal switch SD1 to feed control to the set coil R4-S of a latching relay R4 through the normally-closed contact 5b1 of the relay R5, a second drum signal switch SD2 and the contact 2a1 of the relay R2 which is closed already, and the set coil R4-S of the latching relay R4 is excited to set the latching relay R4 (FIG. 11(*u*)) and to close its normally-open contact 4a1. Upon closure of the normally-open contact 4a1, the clutch CL1 is energized through the manual paper-feeding cover switch SU5*b* and a random cut switch SE2, with the paper feeding rollers 33a and 33b being driven (FIG. 11, (*p*) and (*z*)) to transport the leading edge 32a of the copy paper from the roll 32 in the direction of the arrow "*e*" (FIG. 1) along the guide plate 34 for transportation. Thus, the switches SP1 and SP2 for detecting the leading edge are switched on respectively (FIG. 11, (*f*) and (*g*)), and the high voltage power source HT1 of the charger 70 is energized (FIG. 11, (*g1*)) to uniformly apply, onto the photoreceptor surface 4 of the photoreceptor drum 2, a negative electric charge produced in the wire electrode 70*a* of the charger 70, while the relay R5 is excited (FIG. 11(*v*)) for switching over a contact 5T1 and a contact 5T2. Through the switching-over of the contact 5T1, a platform lock solenoid SL1, the control cam lock solenoid 14 and the scan clutch CL2 are energized respectively (FIG. 11, (*a*1), (*b*1)), while through the switching-over of the contact 5T2, the exposure lamp 21 is energized (FIG. 11(*d*1)), with heating of the lower heater H2 (FIG. 11(*f*1)) being suspended.

Upon energization of the scan clutch CL2, the platform 19 is moved in the direction of an arrow "*b*", and the platform positioning switch SE1 is switched-over (FIG. 11(*m*)), with the platform lock solenoid SL1 and the control cam lock solenoid 14 de-energized, while the switches SE1' and SE1''' are opened, thus the operating sequence becomes independent, even if the print switch SU3' is turned on. When the platform 19 advancing in the direction of an arrow "*b*" reaches a position corresponding to the length of the original 23, the random cut switch SE2 is turned on to be switched over to a position opposite to that in FIG. 10 for energizing (FIG. 11(*y*)) the cutter solenoid SL2 so as to drive the cutters 35*a* and 35*b* (FIG. 11(*n*)), thereby to cut the copy paper 32 to a length corresponding to the original 23. At the same time, a cutter on-switch SS1 is turned on (FIG. 11(*o*)) to energize the reset coil R4-R of the latching relay R4 so as to open the normally-open contact 4*a*1 from its closed position again, with the energization of the cutter solenoid SL2 being suspended to complete the paper-feeding and paper-cutting operations.

As the trailing edge of the cut copy paper sheet 32 passes the leading edge detection switch SP1, the switch SP1 is opened from its closed state to suspend current flowing to the high voltage power source HT1, thereby to suspend application of the negative electric charge onto the photoreceptor drum 2 from the corona charger 70. As the copy paper 32 further advances in the direction of the arrow "*e*" so its trailing edge passes the trailing edge detection switch SP2, the switch SP2 is also opened from its closed state to de-energize the relay R5, thus restoring the contact 5T1 and the contact 5T2 to the condition as shown in FIG. 10. Thus, the scan clutch CL2 is de-energized and, at the same time, the platform position detection switch SE1 is switched over to the contact opposite to that shown in FIG. 10. Accordingly, the current flows to the return clutch CL3 (FIG. 11(*c*1)) and the platform 19 is transported in a direction opposite to that of the arrow "*b*". Also, through the switching over of the contact 5T2, the exposure lamp 21 is turned off, and the lower heater H2 is turned on.

On the other hand, the drum shaft 3 is rotated in synchronization with the movement of the platform 19 in the direction of the arrow "*b*". The photoreceptor drum 2 and the drum cam 6 rotate in the direction of the arrow "*a*", while the control cam 9 is rotated in the direction of the arrow "*a*" through the control cam driving gear 8, in a period slightly shorter than the rotating period of the drum cam 6, when the control cam lock solenoid 14 is excited. Thus, the cam regular position switch SC1 is switched over (FIG. 11(*i*)). Meanwhile, the light rays from the exposure lamp 21 directed to a predetermined position of the platform 19 are applied sequentially onto the original 23 through the glass face 22 as the platform 19 advances in the direction of the arrow "*b*" of the platform 19. The light rays reflected therefrom are sequentially projected onto the photoreceptor surface 4 of the photoreceptor drum 2 through the mirror 24, the mirror lens 25, and the mirrors 26 and 27. Accordingly, the photoreceptor 4 rotates, forming electrostatic latent images corresponding to contents of the original 23, with the negative charge being removed where the density of the original 23 is low, and with the negative charge remaining where the density thereof is high.

As the photoreceptor 4 rotates, the control cam 9 is also rotated in the direction of the arrow "*a*" independently, and a switch operating plate 9*b* of the control cam 9 (FIGS. 2 and 3) comes into contact with the operating lever 17. Accordingly the operating lever 17 rotates counterclockwise against the force of the spring (not shown) to engage into a stepped portion 18*b* of a supporting lever 18, and is held in the position illustrated by the solid lines of FIG. 3 to turn on a developing switch SK1. When the developing switch SK1 is turned on (FIG. 11(*q*)), the developing motor M2 is driven (FIG. 11(*x*)) to rotate the outer cylinder 30*a*, toner supplying roller (not shown), developing material diffusing roller 28*a* and developing material stirring impeller 28*b*. Thus, the toner which is stored in the toner tank 29 is charged to a positive polarity by the carrier of the developing material, and is attracted sequentially, through the outer cylinder 30*a*, onto the portion of the photoreceptor surface 4 which has been charged to a negative polarity to manifest the static latent images.

When the image which has been manifested through adherence of the toner confronts the transfer charger 41, and the sheet 32 is fed along the guide plate 34, the transfer switch SC2 is closed (FIG. 11(*j*)) by the control cam 9 and the transfer charger 41 is energized (FIG. 11(*hl*)) for sequentially attracting the toner particles on the photoreceptor surface 4 onto the copy paper sheet 32. When the transfer switch SC2 is closed, the relay R6 is excited to close the contact 6*a*1 and the contact 6*a*2 so as to self-retain the relay R6.

During the above period, the pin 6*a* of the drum cam 6 comes into contact with the other end of the supporting lever 18 through rotation of the cam 6, and the operating lever 17 returns to its original position shown in the dashed line in FIG. 3 to turn off the latch switch SK1, and to stop the developing motor M2 to complete the developing operation. Immediately after this, namely, after the toner has been attracted onto the sheet 32, a transfer offswitch SD3 is switched over by the drum cam 6, which opens the switch SD3 and denergizes the transfer charger 41.

The copy paper sheet 32 is separated from the photoreceptor surface 4 by the separating claw 42 and is transported by adherence to the surface of the transporting belt 43. The switch SP5 for detecting the sheet separation is switched over, with the contact opened. Thus, even if a switch SD4 for detecting unsuccessful separation is turned on by the drum cam 6 immediately after this to close the contact, a latching relay R7 is not energized and is set. As the copy paper sheet 32 is further transported, the toner is fused onto the sheet 32 by fixing rollers 44*a* and 44*b*, and thus the sheet 32 is discharged out of the apparatus 1 through the discharging rollers 45*a* and 45*b* to turn on the discharge detection switch SP6 (FIG. 11(*h*)). Thus, the discharge detection switch SP6 is switched over from a contact "*a*" to a contact "b" to discharge the electric charge which is charged in a capacitor 94, through a jam detecting switch SD5 and a resistor 98. After the sheet 32 has passed the discharge detection switch SP6, the switch SP6 is turned off again for switching over the contact from "b" to "a". In this case, the multi-dial switch SU2 is switched over to a contact "a", and the capacitor 94 is charged through a resistor 95. In this manner, the copying operation for a first sheet 32 is completed.

During the copying operation of the first sheet, when the platform 19 is transported in the opposite direction shown by the arrow "b" and is returned to its original position, the multi-dial is counted down by one to close the multi-start switch SE3 (FIG. 11(*l*)). In this case, the relay R2 is excited in a manner similar to the copying operation of the first sheet through a function (not shown) for retaining, in the above-described condition, namely, in the closed condition, the multi-dial switches SU2 and SU2' provided between "2" and "1" of the display of the multi-dial. Since the contact 5b1 of the relay R5, the paperfeeding switch SS2, and a second drum signal switch SD2 are all kept closed, the relay R2 is self-retained by the contact 2a1.

Subsequently the platform 19 is transported in the direction of the arrow "b" again after the copying operation of the first sheet, and a second copying operation is effected through operation similar to that described hereinabove. As the platform 19 is transported again in a direction opposite to that of the arrow "b", the multi-dial counts down to indicate "1" and the multi-dial switch SU2' opens, and thus even when the multi-start switch SE3 closes through the returning of the platform 19 to its original position, the relay 2 remains de-energized. Similarly, upon the counting-down of the multi-dial, the multi-dial switch SU2 is switched over from a contact "a" to contact "b", while the contact 2T1 of the relay R2 is also closed the "b" side, and the terminal voltage of the capacitor 94 becomes the base-emitter voltage of the transistor 96.

An automatic shutting off arrangement of the copying apparatus will be described hereinbelow.

When the copying operation of the second sheet is completed and the sheet 32 is discharged out of the apparatus, and the discharge detecting switch SP6 is turned on, the contact is switched over from "a" to "b" so that the electric charge of the capacitor 94 is discharged through a resistor 98, and the terminal voltage of the capacitor 94 is reduced to zero. Accordingly, even when the switch SP6 is switched over from "b" to "a" again after the sheet 32 has passed, the base voltage of the transistor 96 becomes zero momentarily. Thus the transistor 96 is turned off to de-energize the relay R3, and the contact 3a1 being opened to release the self-retaining of the relay R3. Accordingly, the contacts 3a3 and 3a4 of the relay R3 are opened and the current flowing through the main motor M1, the eraser lamps 47 and 50, and the charge erasing transformer 97 is suspended, while the power is still supplied to the cleaner motor M5 and the suction motor M4 through the resistor 99 for driving the same at reduced efficiency. Also, upon opening of the contacts 3a2 and 3a4 through the de-energization of the relay R3, the current flowing through each control circuit for the copying operation is also suspended automatically to stand by for the next copying operation. Accordingly, useless power consumption during the non-operating period of the apparatus 1 is maintained at a minimum level. In order to cut off the current flowing through the apparatus 1 completely, the main power supply off-switch SU4 is opened to break the contact of the relay R8, and thus the self-retaining of the relay R8 is removed to suspend power supply.

The copying operation by the manual copy paper feeding will be described hereinafter.

In order to feed the manual insertion sheet into the apparatus 1, the cover plate 39 (FIG. 1) for manual feeding is rotated counterclockwise to the lowered position, thus the contact of the cover switch SU5*a* for manual feeding is closed, and the contact of each of the switches SU5*b*, SU5*c* and SU5*d* is switched over from the contact "a" to "b". In this case, the platform 19 is still located in the predetermined position and thus the contact of the switch SE1 for detecting the predetermined position of the platform 19 is in the position as shown, with the contact of a temporary stop switch SP4*a* being closed. Accordingly, the current flows through the paper feeding clutch CL1 by the closure of the contact of the manually fed cover switch SU5*a*.

Upon insertion of the sheet for manual feeding into the opening 38 for the manual paper feeding (FIG. 1) the contact of the manual insertion detection switch SP3 is closed through the passing of the manual feeding sheet so as to turn on the transistor 96, and the relay R3 is excited to close the contact 3a1 so that it may be self-retaining while contacts 3a3 and 3a4 are closed for supplying power to each control circuit in the rear stage. Thus, the main driving motor M1 is driven and the paper feeding rollers 40a and 40b rotate through the paper feeding clutch CL1 so that the manually fed sheet is drawn into the apparatus 1. The manually fed sheet, first, switches over the temporary stop switches SP4*a* and SP4*b*, and thus the contact of the SP4*a* is opened to suspend the current flowing through the paper feeding clutch CL1. Upon stopping of the manual feeding sheet at a predetermined position, the contact of the switch SP4*b* is switched over from "b" to "a", and the relay R2 is excited and at the same time, is self-retained through the contact 2a1 for standing by until the first drum signal switch SD1 is turned on, namely, the photoreceptor drum 2 rotates up to a predetermined position.

As the drum cam 6 rotates through the rotation of the photoreceptor drum 2 and the first drum signal switch SD1 is turned on, with the contact thereof closed, the current flows through the setting coil R4-S of the latching relay R4, and the contact 4a1 thereof is closed to flow the current to the paper feeding clutch CL1 again. Thus, the manually fed sheet is transported along the guide plate 34, while the leading edge of the sheet passes the switch SP1 for detecting the leading edge and the switch SP2 for detecting the trailing edge to turn on the switches SP1 and SP2, thus the relay R5 is excited to switch over the contact 5T1, thereby to move the platform 19 and the control cam 9. If the random cut switch SE2 is switched over during the movement of the platform 19, the current continues to flow through the paper feeding clutch CL1, since the contact of the manual feeding cover switch SU5*b* is already switched to "b" side. Therefor, no current flows through the cutter solenoid SL2.

As the manually fed sheet is further transported and the trailing edge of the manually fed sheet has passed the temporary stop switches SP4*a* and SP4*b*, both of the switches SP4*a* and SP4*b* are turned off and the contact of the switch SP4*b* is switched over to "b" side, causing current to flow through the resetting coil R4-R of the latching relay R4, and thus opening the contact 4a1. At this time, as the platform 19 starts to move, the platform positioning switch SE1 is switched over to a position opposite to that as shown in FIG. 10. Thus, no current flows through the paper feeding clutch CL1. And through the same operation as in the roll paper described earlier, the contents corresponding to the original are copied on the manually fed sheet with the sheet being subsequently discharged out of the apparatus.

Hereinbelow, the copy paper jam detection arrangement employed in the copying apparatus of this invention will be described.

If a paper jam takes places during the paper feeding portion of the copying operation, the leading edge of the sheet closes the switches SP1 and SP2 for detecting the leading edge, and before the relay R5 is de-energized, the second drum signal switch SD2 is switched over through the rotation of the drum cam 6. At this time, if the paper feeding clutch CL1 has been actuated, and the paper feeding onswitch SS2 is opened, the switch SS2 and the switch SD2 stop the current flow through the relay R2, and thus, the relay R2 is de-energized. This current is caused to flow through the resetting coil R4-R of the latching relay R4, and the contact 4a1 thereof is opened to stop the current flowing through the paper feeding clutch CL1. Thus, the paper feeding operation is suspended.

Should a paper jamm take place due to unsuccessful separation in the sheet separating portion, the switch SD4 for detecting the unsuccessful separation is turned on through the rotation of the drum cam 6, and the normally closed switch SP5 for detecting separation is not opened, since the sheet has not passed the switch SP5. Accordingly, current flows to the setting coil R7-S of the latching relay 7 through the contact 6a1 already closed and the contact 7T1 is switched over from "*a*" to "*b*" to light a pilot lamp 100 for indicating the jam and to de-energizing the relay 8 so as to open the contacts 8a1 and 8a2. Thus, all the power supply to the apparatus 1 is cut off to stop operation of the apparatus 1. When the jam resetting switch SU6 is closed after the sheet which caused the paper jamming has been taken out, the resetting coil R7-R of the latching relay R7 is energized for switching over the contact 7T1 to the "*a*" side to again energize the relay R8. Thus, the contacts 8a1 and 8a2 are closed to energize the control circuit in each rear stage for restoring the original condition.

Additionally, if a paper jam takes place due to unsuccessful transportation of the sheet at the fixing station, the contact of the separation detecting switch SP6 remains closed to the "*a*" side, since the sheet does not pass therethrough, and since the jamming detection switch SD5 is turned on through the rotation of the drum cam 6, the contact thereof is switched over for applying the electric charge of the capacitor 94 to the setting coil R7-S of the latching relay R7 through the contact 6a1. Accordingly, similar to the above case, the contacts 8a1 and 8a2 of the relay R8 are opened respectively to stop the power supply to the apparatus 1. The operation of the jam resetting switch SU6 is the same as in the above described case.

Finally, the case in which the power supply to the apparatus is suspended due to accidents such as power failure during the copying operation will be described.

Firstly, if the power failure takes place before or after the energization of the transfer charger 41 and the power supply switches SU1 and SU1' are turned on after restoration of the power failure, the current is again caused to flow through the transformer 88 and the full wave rectifier 89 and also to the temperature regulating circuit 81, and thus the relay R1 is excited to open the contact 1b and to close the contact 1a, while the relay R8 is excited to close the contacts 8a1 and 8a2 to self-retain the power supply circuit. Since the relay R3 remains de-energized the apparatus 1 is kept inoperative at a condition before the power supply was cut off. And upon closure of the print switch SU3, the transistor 96 is turned on, and the relay R3 is energized, and the contact 3a1 thereof is closed to self-retain the relay R3, while the contact 3a2 is closed to flow the current to each circuit in the rear stage. Also, the contacts 3a3 and 3a4 are closed to flow the current through each of the motors M1, M2 . . . M5 and the circuit in the rear stage. Thus, the copying operation which is suspended is continued, and the sheet is discharged out of the apparatus 1.

Furthermore, during the operation of the transfer charger 41, if the power supply is cut off as described hereinabove, and the print switch SU3 is closed after turning on the power switches SU1 and SU1' a similar operation to that described hereinabove is effected. In this case, since the contact of the transfer on-switch SC2 is opened after it is closed by pulse-like signal, once the relay R6 is de-energized due to interruption of the power supply, no current flows through the transfer transformer, i.e., through the transfer charger 41. Thus, the print switch SU3 excites the relay 3 to close the contact 3a3 thereof and to flow current through the suction motor M4, in which case, since the sheet is not electrostatically attracted onto the photoreceptor drum 2 even when the rising of the suction force of the suction fan is slow, the sheet is separated easily from the photoreceptor drum 2 for transportation, and is discharged out of the apparatus 1.

FIG. 12 shows a modification of the power failure protection circuit of the apparatus 1. During the energization of the transfer charger 41, if the print switch SU3 is turned on to close the contact after restoration of the power failure, the transistor 96 is turned on to energize the relay R4 and the contact 4a4 thereof is closed for energizing the circuit in the rear stage, while the contact 4a3 is also closed for self-retaining the relay R4 to restore the condition before the power failure. In this case, since the transfer-on switch SC2 is already opened after it is once closed in the pulse-like manner, a thyristor S remains off, namely, memorizes the occurrence of the power failure and the transfer transformer, i.e., the transfer charger 41 is not energized. Accordingly, as described hereinabove, the sheet is separated easily from the photoreceptor drum 2 for being transported and is discharged out of the apparatus 1 without causing any paper jam.

Referring also to FIGS. 13 and 14, one example of the circuit construction of the developing biasing voltage timing control means for charging only the latent image forming portion, without charging the non-image forming portion of the photoreceptor mentioned earlier is described hereinbelow.

The static latent images formed on the photoreceptor surface 4 are developed by the magnetic brush developing apparatus 28 (FIG. 1). A variable bias applying means V as shown in FIG. 14 is coupled to the magnetic brush to be formed on the outer cylinder 30a. In the bias applying means V, an electric supply E (AC 100 V) is connected to the primary side of a developing bias transformer Td, to which a resistor R2 is connected in parallel, through a normally-open contact of a switch SWD connected in parallel to a resistor R1 for voltage dropping, while a secondary side thereof which is conneceted in series to a diode Dr for rectification and in parallel to the resistor R3 and a smoothing capacitor C is connected to the outer cylinder 30a of the developing roller 30. The switch SWD is installed at a point C which is away from a transfer point A (the position of the transfer charger 41) on the passage for transporting the copy paper by an interval equivalent to AB (the distance from the developing point B to the transfer point A). Accordingly, as the transfer paper which is transported in association with the copying operation arrives at the point C to turn on the switch SWD, developing bias voltage of −300 to −400 V is applied onto the outer cylinder 30a of the magnetic roller 30. At this time, the front edge of the latent image formed portion on the photoreceptor surface 4 is located at the developing point B, and the latent images having the electric charge of −700 to −800 V on the image-formed portion are developed by the toner in the earlier described manner. On the other hand, background portion exposed through projection from the mirror 27 has the residual potential of −100 to −200 V, but no toner adheres due to the effect of the above described bias voltage, thus ensuring so-called fog-free developing operation.

Application of −300 to −400 V bias voltage as described above is continued during the developing time period. In other words, since "on" state remains until the copy paper passes the switch SWD, and the "on" state is switched over to "off" state when the copy paper passes, the 100 V a.c. from the power source E is applied, through the resistor R1 for voltage dropping, to the primary side of the developing bias transformer Td.

As the switch SWD is turned off, the output from the secondary side of the transformer Td becomes −100 to −200 V to apply the bias voltage onto the outer cylinder 30a. This condition continues till the next developing operation, namely, until the leading edge of a subsequent copy paper actuates the switch SWD to turn it on. Accordingly, although the magnetic brush formed on the outer cylinder 30a comes into sliding contact with the nonimage formed portion of the photoreceptor surface 4, the adhesion of the toner thereto is prevented due to the presence of bias voltage of −100 to −200 V as described above.

The toner powder image on the image-formed portion of the photoreceptor surface 4 is transferred onto the copy paper by the transfer charger 41 and the copy paper sheet having the toner powder image thus transferred is transported to the fixing device for the fixing operation, while the toner remaining on the photoreceptor surface 4 is removed by the cleaning device 48.

It should be noted that the biasing voltage timing control means is not limited in its arrangement to the above described embodiment, but may be modified in various ways. For example, the position of the switch SWD may be spaced in distance more than AB from the transfer point A. Needless to say, the switching operation of the switch SWD has only to be effected through detection of the time when the magnetic brush formed on the outer cylinder 30a comes into contact with the leading edge of the image-formed portion and then leaves the trailing edge thereof, namely, through detection of the developing period. In the above embodiment, the switch SWD is arranged to be responsive to the transportation of the copy paper, because the actuation of the switch SWD is readily associated with the copying operation.

Referring now to FIGS. 15 to 17, there is shown the detailed construction of the copy paper cutting means K employed in the copying apparatus of FIG. 1. The cutting means K includes an arrangement for preventing copy paper jamming at the cutting means K wherein a stationary blade 35a and a rotary blade 35b are employed. In FIG. 1, after the leading edge of the copy paper 32 is drawn from the paper roll through the feeding rollers 33a and 33b, and a predetermined amount of the copy paper has been fed through the space between the stationary blade 35a and the rotary blade 35b, the rotation of the rollers 33a and 35b is suspended by a cutting signal developed by suitable means (not shown) in the copying apparatus, and the rotary blade 35b is simultaneously rotated counterclockwise by suitable means such as a solenoid (not shown) in the direction shown by the solid line arrow in FIGS. 15 and 16 toward the stationary blade 35a for cutting the copy paper 32 therebetween. After completion of cutting, the rotary blade 35b is rotated clockwise as shown by the dashed line arrow in FIGS. 15 and 16 back to the original position, and the copy paper sheet thus cut is further transported into the copying apparatus. In the above described arrangement, if the feeding rollers 33a and 33b are not maintained in a perfectly stationary state when the rotary blade 35b is rotated counterclockwise toward the stationary blade 35a for cutting the copy paper 32, the leading edge of the copy paper from the roll 32 thus cut by the cutter means K is slightly curved upwardly when the rotary blade 35b is to return to the original position and tends to ride over the rotary blade 35b to a certain extent. In the above state, after the rotary blade 35b has returned to the original position, with the copy paper feeding through the rollers 33a and 33b being resumed, the leading edge of the copy paper thus curved goes further onto the rotary blade 35b and may give rise to a paper jam there. Such a problem is advantageously eliminated in the copying apparatus of this invention by an arrangement wherein the movement of the rotary blade or the actuation mechanism associated therewith is utilized for temporarily rotating the feeding rollers 33a and 33b in the reverse direction in association with the movement of the cutter blade after cutting so as to cause the cut edge or leading edge of the copy paper to be retracted from the cutter blades. Thus cutter means provided with a paper jam prevention arrangement is embodied as described in more detail hereinbelow.

In FIGS. 15 to 17, the cutter means K includes a stationary blade 35a and a rotary blade 35b. The rotary blade 35b is secured to one end of a rotary shaft 202 (FIG. 17) which is rotatably supported by a frame 203 of the copying apparatus, while a cutter arm plate 204 is fixedly mounted at a base portion thereof to the other end of the rotary shaft 202. The cutter arm plate 204 further has a cutter arm pin 204a secured to a forward end of the plate 204. The cutter arm pin 204a is slidably received in a corresponding opening of a cutter arm pin receiver 206a formed at one end of a cutter lever 206 which is connected at the other end thereof to a plunger of a solenoid (not shown). A spring 207 is connected between the end of the lever 206 adjacent to the cutter arm pin receiver 206a and the frame 203 of the copying apparatus for normally forcing the cutter lever 206 upward as shown in FIGS. 15 and 16.

On the other hand, a rotary shaft 208 for the upper roller 33*a* of the paper feeding rollers 33*a* and 33*b* is rotatably supported by the frame 203 of the apparatus housing G (FIG. 1). A driving gear 209, a friction clutch mechanism 210, a compression coil spring 211, a roller return plate 212 and a torsion spring 213 (FIG. 17) are mounted on one end of the rotary shaft 208. The driving gear 209 and a friction plate 210*a* of the friction clutch mechanism 210 are engaged with a notch 208*a* of the shaft 208 so that they may be rotated as one unit with the shaft 208. Other friction plates 210*b* and 210*c*, the compression coil spring 211, the roller return plate 212 and the torsion spring 213 are movable independent of the shaft 208. The torsion spring 213 is engaged, at its one end, with a projection 212*a* of the roller return plate 212 and, at its other end, with a pin 214 secured to the frame 203 for normally forcing the roller return plate 212 to pivot clockwise.

Meanwhile, a rocking lever 216 is pivotally supported by a support shaft 215 secured to the frame 203 and is normally forced to pivot counterclockwise by a torsion spring 217. The front end portion 216*a* of the rocking lever 216 is so arranged that it may come into contact with the cutter arm pin receiver 206*a* of the cutter lever 206 when the cutter arm pin receiver 206*a* is moved downward through the action of the solenoid (not shown). The roller return plate 212 is provided with an upper notch 212*b*, a lower notch 212*c* and a rotation regulating claw 212*d*. The lower notch 212*c* and the rotation regulating claw 212*d* are actuated in association with a bent portion 216*b* of the rocking lever 216 in a manner mentioned later.

The operation of the above cutting means K will be described hereinafter.

As a paper feeding signal is transmitted from the copying apparatus (not shown), the rotating force is transmitted from a driving source (not shown) through a proper means such as a clutch, etc. to operate the paper feeding rollers 33*a* and 33*b*. The friction plate 210*a* of the friction clutch mechanism 210 rotates integrally with the shaft 208, while the other friction plates 210*b* and 210*c* are pressed against the driving gear 209 by the compression coil spring 211 to rotate therewith. Since the compressed coil spring 211 is engaged, at one end, with the friction plate 210*c*, and, at its other end, with the upper notch 212*b* of the roller return plate 212, the roller return plate 212 also rotates, against the force of the torsion spring 213, through the rotation of the friction plates 210*b* and 210*c*. When the bent portion 216*b* of the rocking lever 216 engages the lower notch 212*c*, the rotation of the plate 212 stops, so that the contact surfaces of the friction plates 210*a* and 210*b* slide against each other.

The roller return plate 212, the rocking lever 216, the friction plates 210*b* and 210*c*, etc. retain condition (the condition of FIG. 15) independently of the rotation of the shaft 208. When a predetermined amount of paper has been fed, a cutting signal is transmitted from the copying apparatus, and simultaneously with the stopping of the paper feeding rollers 33*a* and 33*b*, a solenoid (not shown) is actuated to pull the cutter lever 206 for rotating the rotary blade 35*b* counterclockwise, through the cutter arm 204 of the cutter means K, and thus the copy paper located between the stationary blade 35*a* and the rotary blade 35*b* is cut. Even after the cutting operation has been completed, the cutter lever 206 continues to descend and the lower portion of the cutter arm pin receiver 206*a* pushes down the front end portion 216*a* of the oscillating lever 216 against the urging force of the torsion spring 217. Accordingly, the bent portion 216*b* and the lower notch 212*c* of the roller return plate 212 are disengaged from each other, and the roller return plate 212 pivots clockwise momentarily due to the force of the torsion spring 213. The rotation regulating claw 212*d* comes into contact with the bent portion 216*b* of the rocking lever 216 for stopping the rotation of roller return plate 212 (the condition of FIG. 16). The input signal to the above mentioned solenoid is then immediately suspended, and the cutter lever 206 is raised by the spring 207 to restore the rotary blade 35*b* of the cutter means K to its original position ready for subsequent cutting to stand by until the next cutting signal is applied thereto.

At this time, as described hereinbefore, the roller return plate 212 pivots clockwise, with the rotation thereof being transmitted to the friction plate 210*a*, through the compression coil spring 211 and the friction plates 210*c* and 210*b* to rotate the rotary shaft 208 of the upper paper feeding roller 33*a* in the same direction. Thus, the paper held between the paper feeding rollers 33*a* and 33*b* is pulled back or retracted by a predetermined amount away from the cutter means K.

When the paper feeding signal is again applied to start the subsequent paper feeding and the upper roller 33*a* of the paper feeding rollers 33*a* and 33*b* is rotated counterclockwise, the friction plates 210*b* and 210*c* are rotated in the same direction through the friction plate 210*a*, as described hereinabove, to transmit the rotation thereof to the roller return plate 212 through the compression coil spring 211. The bent portion 216*b* on the rocking lever 216 which is urged counterclockwise by the torsion spring 217 engages the lower notch 212*c* of the roller return plate 212 to stop the rotation thereof, and this condition remains until a subsequent cutting signal is applied.

Referring now to FIGS. 18 to 20, there is shown a modification K′ of the cutter means K of FIGS. 15 to 17. In this modification, the cutter arm 204 is fixed to one end of the rotary shaft 202 of the rotary blade 35*b* in the similar manner as in the embodiment of FIGS. 15 to 17, while the cutter arm pin 204*a* provided on the end portion of the cutter arm 204 is rotatably coupled to the cutter arm pin receiver 206*a* of the cutter lever 206 which is connected to the plunger of the solenoid (not shown). Furthermore, a pin 206*b* is fixedly provided on the cutter lever 206 at the side thereof opposite to its cutter arm pin receiver 206*a*.

On the other hand, a roller return lever 218 and a friction plate 219 are rotatably provided on one end of the rotary shaft 208 of the upper roller 33*a* of the paper feeding rollers 33*a* and 33*b*. A compression coil spring 220 is engaged, at its one end, with the rotary shaft 208 and, at its other end, with the friction plate 219 for depressing the friction plate 219 against the roller return lever 218. Also, a stopper 221 is fixedly provided on the frame 203 to restrict the rotation of the roller return lever 218.

In this case, the roller return lever 218 rotates synchronously with the shaft 218 by the compression coil spring 220 and the friction plate 219 with respect to the rotation of the paper feeding rollers in the paper feeding direction. When the roller return level 218 comes into contact with the stopper 221, slipping takes place in the contact faces between the roller return lever 218 and the friction plate 219, with the roller return lever 218 coming to a stop, independently of the rotation of the upper paper feeding rollers 33*a*. This condition is shown in FIG. 18. Subsequently the paper feeding rollers 33*a* and 33*b* are stopped by a cutting signal from the copying apparatus (not shown), and simultaneously, a solenoid (not shown) is actuated to pull the cutter lever 206 downwardly to pivot the rotary blade 202*a* counterclockwise to cut the copy paper. Even after the cutting operation, the cutter lever 206 continues to descend. At this time, since the pin 206*b* is so arranged as to contact the front end portion of the roller return lever 218, the roller return lever 218 pivots clockwise about the shaft 208 through the descending of the pin 206*b*. The shaft 208 also rotates in the same direction, through the friction plate 219 and the compression coil spring 220, by the clockwise pivotal motion of the roller return lever 218 to pull back the leading edge portion of the copy paper held between the paper feeding rollers 33*a* and 33*b* by a predetermined amount away from the cutter means K'. When the input signal to the above mentioned solenoid is suspended, the cutter lever 206 is raised by the spring 207, and the rotary blade 35*b* of the cutter means K' is also restored to the original position to stand by until a subsequent application of the cutting signal. The roller return lever 218, etc. act in a manner similar to that described hereinabove when the subsequent paper feeding signal is applied.

In the above-described two embodiments, although the amount of the copy paper to be retracted after the cutting operation is suitably determined through the association of the apparatus with other mechanisms, or the performance of the cutter and the paper feeding roller, or the like, in the first embodiment, the proper amount thereof can be set by adjusting the spacing between the lower notch 212*c* of the roller return plate 212 and the rotation regulating claw 212*d* thereof, while in the second embodiment, such amount can be set by adjusting the position of the stopper 221 or the pin 206*b*.

Referring now to FIGS. 21 to 25, there is shown a modification of the electrophotographic copying apparatus of FIG. 1. In this modification, the automatic shut off arrangement of the copying apparatus wherein the main motor is turned off when the copy paper sheet is discharged out of the apparatus housing is modified to further incorporate a drum switch SD7 (FIG. 22, FIG. 25(*e'*)) which automatically shuts off the operation of the copying apparatus when closed. In other words, although the stopping position of the photoreceptor drum 2 is at random, not being particularly predetermined in the copying apparatus of FIG. 1, such a position is approximately constant in the modification of FIG. 21. Accordingly, the period of time required from the initiation of rotation of the photoreceptor drum 2 upon turning on of the print switch to the start of the copy paper feeding is rendered approximately constant, and by reducing this period of time, the time required for copying can be reduced. Moreover, since the print switch is not necessary for the manual copy paper insertion, it has been so arranged in the modification of FIG. 21 that the main motor does not run even if the print switch is depressed, when the copy paper manual insertion cover plate is lowered to the opened position.

Referring particularly to FIGS. 24 and 25, operation of the automatic shut off arrangement of the modification of FIGS. 21 to 25 is described hereinbelow.

It is to be noted that circuit portions or components modified in the modification of FIG. 24 as compared with the circuit of FIG. 10 are surrounded by dashed lines in FIG. 24 for clarity.

Upon closure of the print switch SU3, the transistor 96 is turned on, with a consequent energization of the relay R3, thus the relay R3 is self-retained through closure of the contact 3*a*1. The capacitor 94 is also charged by the closure of the contact 3*a*1 through a resistor 93, and each of the switches SD7, SP6 and SD5. Although the photoreceptor drum 2 starts rotating upon closure of the print switch SU3 and the drum stopping switch SD7 is opened immediately after rotation of the drum 2 from its stationary position, the capacitor 94 is thereafter charged through the contact 2*a*2 or a switch SK2 (FIG. 25(*n'*)). Upon depression of the discharge detection switch SP6 by the copy paper, the switch SP6 is changed-over to a position opposite to that as shown in FIG. 24, without the switching over of the drum switch SD6, so long as no copy paper jamming takes place, and the capacitor 94 is discharged through the resistor 98. Subsequently, when the trailing edge of the copy paper passes the discharge detection switch SP6 the switch SP6 again returns to the position as shown, in which case, since the switch SK2 and the contact 2*a*2 are both open, the capacitor 94 is not charged. Upon arrival of the photoreceptor drum 2 at the predetermined position, the drum stopping switch SD7 is depressed thereby to be closed. In this state, the base potential of the transistor 96 is momentarily rendered to be zero through the capacitor 94, and the transistor 96 is turned off, so that the relay R3 is released from the self-retaining state to cause the main motor M1 to stop. Accordingly, in the automatic shut off arrangement of the modification of FIGS. 21 to 25, since the drum 2 is caused to stop by the depression of the drum stopping switch SD7 (FIG. 25(*e'*)) through rotation of the drum 2, the position whereat the drum 2 stops is approximately constant. It is to be noted that, in the continuous copying of multiple copy paper sheets in the above described arrangement, when the capacitor 94 is discharged, and the copy paper discharge detection switch SP6 is restored in the state as shown in the drawing, either the contact 2*a*2 of the relay R2 or the automatic shut off prohibiting switch SK2 (newly employed cam switch) is closed to prevent the automatic shut off to take place. It should also be noted that when the manual insertion cover switch SU5*a* to SU5*c* have been switched-over, the relay R3 is not energized even if the print switch SU3 is turned on.

Still referring to FIGS. 21 to 25, the copy paper jam detection arrangement employed in the modification of FIGS. 21 to 25 is described. In the modified jam detection arrangement, the copy paper feed switch SS2 and the switch 2D2 described as employed in the arrangement of FIG. 1 are dispensed with and a jam detection switch SD6 (FIG. 22, FIG. 25(*d*)) is newly employed.

In FIGS. 24 and 25, upon closure of the print switch SU3 and SU3', the relay R3 is energized through actuation of the transistor 96, and is self-retained through closure of its contact 3*a*1, with simultaneous closure of the contact 3*a*2 thereof, in which case, the relay R2 is energized through the switches SU5*d*, SU3', SE1, SC1, etc., and is self-retained by the closure of its contact 2*a*1. Subsequently, the drum signal switch SD1 is closed as the drum 2 rotates and energizes the latching relay R4-S to close its contact 4*a*1, thus actuating the copy paper feed clutch CL1 for starting the copy paper feeding. When the leading edge detection switch SP1 is closed as the copy paper advances, the relay R5 is energized and its contact 5*b*1 is opened, thus the relay R2 is released from its self-retaining state. When further copy paper transportation is normally carried out, the copy paper is continuously fed, without the charge of the capacitor 94 flowing into the relay 7 through the contact 2a3, since the leading edge jam detection switch SD5 (FIG. 25(*h'*)) is turned on (the opposite state to that shown in the drawing) by the drum cam. On the contrary, should a paper jam take place at the copy paper feed portion or the cutter portion, since the leading edge jamming detection switch SD5 is turned on before turning on of the leading edge detection switch SP1, the charge of the capacitor 94 is applied to set input of the relay R7 through the contact 2a3 of the relay R2 for turning on a jam indication pilot lamp 100 by closing the contact 7a1 of the relay R7 and also for suspending energization of the relay R1 by opening the contact 7b2, thus the operation of the copying apparatus is suspended. When the leading edge jam detection switch SD5 is turned on by the second rotation of the drum 2, if the copy paper is being normally transported, and the copy paper discharge detection switch SP6 is switched by the copy paper, the charge of the capacitor 94 is discharged through the resistor 98, thus no particular inconvenience is experienced. If the copy paper, however, should be clogged between the positions of the leading edge jam detection switch SD5 and the discharge detection switch SP6, the switch SP6 is not switched, and therefore the relay R7 is set through actuation of the drum switch SD5 in the manner as described earlier for the detection of a jam.

Subsequently, the jam detection at the copy paper discharging portion is described hereinbelow.

While the copy paper is passing on the copy paper discharge detection switch SP6, the charge of the capacitor 94 is discharged through the resistor 98 along the path through the switches SD5, SP6 and SD6, in which case, the trailing edge detection switch SD6 is so arranged as to be turned on by the drum cam after the longest copy paper has switching the copy paper discharge detection switch SP6 and is subsequently discharged. In this state, if the copy paper continues to switch the discharge detection switch SP6 by a copy paper jam thereat, the switch SD6 is switched over through rotation of the drum 2 and the capacitor 94 is charged through the switches SD6, SP6 and SD5, and a transistor 101 is thus turned on. Consequently, the relay R7 is set for indicating a paper jam, the mechanical operation of the copying apparatus is suspended, and the heaters, etc. are de-energized. If the paper jam should take place with the copy paper not depressing the switch SP6, detection is made in the manner mentioned earlier. It should be noted here that in the modified circuit construction of FIGS. 21 to 25, jam detection at the copy paper separating section is not specifically carried out, but is arranged to be made collectively with the jam detection between the copy paper leading edge and the copy paper discharge portion. It should also be noted that the difference in operation of the modification of FIGS. 21 to 25 from the embodiment of FIG. 1 resides in that the main relay R8 remains as it is, when a jam is detected, while power supply to the temperature control circuit and the relay R1 is suspended, and also in that not only the copy paper feed device, but also the relay R1 are turned off during a copy paper jam at the copy paper feed section.

In the modification of FIGS. 21 to 25, a copy paper empty detection arrangement which is not included in the embodiment of FIG. 1 is further incorporated as described hereinbelow.

In FIGS. 23 and 24, a switch SP8 is employed for copy paper empty detection, and is adapted to be closed in the presence of the copy paper. For example, a slit (not shown) allowing the actuator of the switch SP8 to enter may be formed in a position several tens of centimeters away from the final end of the rolled copy paper (i.e., a copy paper length sufficient for an operator to hold and pull the final end of the copy paper when the feeding rollers 33a and 33b stop upon detection of absence of copy paper) for detecting the absence of the copy paper when the actuator enters the slit and the switch SP8 is opened. In that case, the switch SP8, upon opening thereof, releases the relay R3 from its self-retaining state for causing the main motor to stop. It is to be noted that the switch SP8 may be replaced by a normally open contact of a suitable relay (not shown), with output of a photoelectric element (not shown) being utilized for actuation of the relay. In such a case, a slit or colored mark is provided at the final end of the roll paper for detection thereof by the photoelectric element.

In the arrangement of FIG. 1, control for turning on or off of the developing device is effected by the mechanical latch switch SK1 which is latched by the control cam and released from latching by the drum cam. In other words, the developing device remaining actuated for a predetermined period of time, irrespective of the length of the copy paper. In the above arrangement, however, there is a possibility that the toner is unnecessarily supplied, since in the developing device, the developing roller and the toner supplying roller are driven by the same driving source. For further improvements, in the modification of FIGS. 21 to 25, a developing switch SP7 (FIG. 25(*q*)) which is kept closed during passing of the copy paper is employed for actuating the developing device. It is to be noted that although the position and action of the switch in the circuit is similar to those in the embodiment of FIG. 1, the modification differs therefrom in that the timing for closure of the switch is different, depending on the lengths of the copy paper. In FIG. 21, the switch SP7 is disposed in the transportation path of the copy paper before the transfer station.

Since the remaining construction and function of the modified copying apparatus of FIGS. 21 to 25 are similar to those of FIGS. 1 to 20, detailed description thereof is omitted for brevity.

As is clear from the foregoing description, according to the electrophotograhic copying apparatus of the present invention, the control of each of the corona charging and exposure processes is effected through the first group of switches disposed along the path of the copy paper sheet for aligning the leading edge of the copy paper with that of the image on the photoreceptor surface, while the starting of the transfer device and function of the copy paper separation process are controlled through the control cam driven by actuating signals from one of the switches of the first switch group, with the developing and transfer functions being adapted to be suspended by the drum cam which rotates as one unit with the photoreceptor drum, so that not only the number of switches which may give rise to copy paper jamming on the path of the copy paper sheet can be reduced, but also undesirable developing and transfer at the discontinuity i.e., at the slot portion or the seam of the photoreceptor surface are advantageously prevented, thus definite copied images of high quality are constantly obtained through the simple control circuit.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. In an electrophotographic copying apparatus for effecting a series of copying operations which comprises a photoreceptor drum having a photoreceptor surface disposed on an outer periphery thereof, said photoreceptor surface having a discontinuity at a portion thereof, corona charging means for preliminarily charging said photoreceptor surface, exposure means for exposing said preliminarily charged photoreceptor surface to light images of an original to be copied through light rays transmitting means so as to form an electrostatic latent image of said original on said photoreceptor surface, scanning means for scanning a surface of said original, developing means for developing the electrostatic latent image formed on said photoreceptor surface into a visible toner image, transfer means for transferring said visible toner image onto transfer material transported following rotation of said photoreceptor drum, separation means for separating the transfer material from said photoreceptor surface after the transferring of said visible toner image onto the transfer material, and fixing means for fixing said visible toner image transferred onto the transfer material to said transfer material thus separated from said photoreceptor surface, an improvement of said electrophotographic copying apparatus which comprises:

means for initiating rotation of said photoreceptor drum;

a drum cam which rotates as one unit with the rotation of said photoreceptor drum;

a control cam coaxial with said drum cam which rotates independently of the rotation of said drum cam;

a first group of switches including at least a first switch, a second switch and a third switch disposed on the circumference of rotation of said drum cam for actuation by said drum cam;

a second group of switches including at least a first switch and a second switch disposed on the path of the transfer material for actuation by passage of the transfer material, said first switch being adapted for connection to said corona charging means, said scanning means and said exposure means for actuation of said corona charging means, said scanning means and said exposure means when actuated, and said second switch being actuated upon discharge of the transfer material out of said copying apparatus during normal operation;

a third group of switches disposed on the circumference of rotation of said control cam for actuation by said control cam;

a control cam rotation driving means associated with said control cam and coupled to said first switch of said second group of switches for starting rotation of said control cam with a rotational period less than the rotational period of said drum cam when said first switch of said second group of switches is actuated and for stopping the rotation of said control cam after one revolution; and a transfer material feeding means coupled to said first, second and third switches of said first group of switches and said first and second switches of said second group of switches, for starting to feed the transfer material to said copying apparatus when said first switch of said first group of switches is actuated; for continuing to feed the transfer material to said copying apparatus when said second switch of said first group is actuated after said first switch of said second group is actuated, for ceasing to feed the transfer material to said copying apparatus when said second switch of said first group of switches is actuated without actuation of said first switch of said second group of switches and for ceasing to feed the transfer material to said copying apparatus when said third switch of said first group of switches is actuated without actuation of said second switch of said second group of switches.

2. An electrophotographic copying apparatus as claimed in claim 1, wherein the actuation of one of the switches of said third group of switches controls the function of at least said transfer means.

3. An electrophotographic copying apparatus as claimed in claim 1, wherein said third group of switches includes at least one switch having a switch actuation mechanism actuated by said control cam and released from actuation by said drum cam.

4. An electrophotographic copying apparatus as claimed in claim 3, wherein said at least one switch of said third group of switches actuated by said switch actuation mechanism controls said developing means.

5. An electrophotographic copying apparatus as claimed in claim 1, wherein said drum cam and said first switch of said first group of the switches are disposed in positions for preventing said discontinuity of said photoreceptor surface of said photoreceptor drum from passing said corona charging means, said scanning means and said exposure means when said corona charging means, said scanning means, and said exposure means are functioning.

6. An electrophotographic copying apparatus as claimed in claim 1, wherein said first switch of said second group of switches is disposed in the path of the transfer material in a position between said transfer material feeding means and said transfer means, wherein said second switch of said second group of switches is disposed in the path of the transfer material in a portion of the path extending from said fixing means in a direction toward the discharge of the transfer material, wherein said second switch of said first group of switches is disposed in a position for actuation by said drum cam after the period of time from the actuation of said first switch of said first group of switches by said drum cam until the actuation of said first switch of said second group of switches by the passage of the transfer material, and wherein said third switch of said first group of switches is disposed in a position for actuation by said drum cam after a sufficient period of time from the actuation of the first switch of said first group of switches to allow the passage of the longest of the transfer material which can be used past said second switch of said second group of switches.

7. In an electrophotographic copying apparatus for effecting a series of copying operations which comprises a photoreceptor drum having a photoreceptor surface disposed on an outer periphery thereof, said photoreceptor surface having a discontinuity at a portion thereof, corona charging means for preliminarily charging said photoreceptor surface, exposure means for exposing said preliminarily charged photoreceptor surface to light images of an original to be copied through light rays transmitting means so as to form an electrostatic latent image of said original on said photoreceptor surface, scanning means for scanning a surface of said original said scanning means being variable in its distance of scanning movement according to length of the original to be copied, developing means for developing the electrostatic latent image formed on said photoreceptor surface into a visible toner image, transfer means for transferring said visible toner image onto transfer material transported following rotation of said photoreceptor drum, separation means for separating the transfer material from said photoreceptor surface after the transferring of said visible toner image onto the transfer material, and fixing means for fixing said visible toner image transferred onto the transfer material to said transfer material thus separated from said photoreceptor surface, an improvement of said electrophotographic copying apparatus which comprises:

a rotation starting means for initiating rotation of said photoreceptor drum upon starting of the copying operation of said electrophotographic copying apparatus;

a drum cam which rotates as one unit with said photoreceptor drum, said photoreceptor drum and drum cam making at least two rotations per copying cycle;

a first group of switches disposed around said drum cam for actuation through rotation of said drum cam, said first group of switches including at least first and second switches;

a second group of switches disposed in the passage for transportation of the transfer material for actuation by passage of the transfer material;

scan starting means coupled to said first switch of said second group of switches for starting movement of said scanning means upon actuation of said first switch of said second group of switches;

a third group of switches for detecting positions of said scanning means, said third group of switches including at least a first switch for detecting the stopping position of said scanning means, a rotation stopping means coupled to said second switch of said first group of switches for stopping the rotation of said photoreceptor drum upon actuation of said second switch of said first group of switches;

a rotation continuing means coupled to said second switch of said first group of switches for preventing the functioning of said rotation stopping means to allow said photoreceptor drum to rotate continuously upon actuation of said second switch of said first group of switches, said rotation continuing means actuated for at least at the first rotation of said photoreceptor drum, wherein said photoreceptor drum makes at least two rotations per copying cycle;

a transfer material feed means for feeding and transporting the transfer material from stock position; and a feed actuation means coupled to said first switch of said first group of switches, said first switch of said third group of switches and said transfer material feed means for actuating said transfer material feed means upon actuation of said first switch of said first group of switches and detection of the stopping position of said scanning means by said first switch of said third group of switches.

8. An electrophotographic copying apparatus as claimed in claim 7, wherein said third group of switches for detecting the positions of said scanning means further includes a second switch for detecting the completion of the scanning movement and starting of returning of said scanning means, said second switch means being set so as to be variable in timing of its functioning.

9. An electrophotographic copying apparatus as claimed in claim 7, further comprising:

a copying number setting means coupled to said feed actuation means, said rotation stopping means, said rotation continuing means, said first switch of said first group of switches and said first switch of said third group of switches, for setting the number of copies to be made *n*, for actuating said rotation continuing means if said first switch of said first group of switches is actuated and said first switch of said third group of switches does not detect said scanning means in the stopping position, for actuating said rotation continuing means and said feed actuation means if said first switch of said first group of switches is actuated, said first switch of said third group of switches detects said scanning means in the stopping position and the number of copies made is less than *n*, for deactuating said feed actuation means, actuating said rotation continuation means once and then actuating said rotation stopping means if the number of copies made equals *n*.

10. In an electrophotographic copying apparatus for effecting a series of copying operations which comprises a photoreceptor drum having a photoreceptor surface disposed on an outer periphery thereof, said photoreceptor surface having a discontinuity at a portion thereof, corona charging means for preliminarily charging said photoreceptor surface, exposure means for exposing said preliminarily charged photoreceptor surface to light images of an original to be copied through light rays trnasmitting means so as to form an electrostatic latent image of said original on said photoreceptor surface, scanning means for scanning a surface of said original said scanning means being variable in its distance of scanning movement according to length of the original to be copied, developing means for developing the electrostatic latent image formed on said photoreceptor surface into a visible toner image, transfer means for transferring said visible toner image onto transfer material transported following rotation of said photoreceptor drum, separation means for separating the transfer material from said photoreceptor surface after the transferring of said visible toner image onto the transfer material, and fixing means for fixing said visible toner image transferred onto the transfer material to said transfer material thus separated from said photoreceptor surface, an improvement of said electrophotograhic copying apparatus which comprises:

a rotation starting means for initiating rotation of said photoreceptor drum upon starting of the copying operation of said electrophotographic copying apparatus;

a drum cam which rotates as one unit with said photoreceptor drum, said photoreceptor drum and drum cam making at least two rotations per copying cycle;

a first group of switches disposed around said drum cam for actuation through rotation of said drum cam, said first group of switches including at least first and second switches;

a second group of switches for detecting positions of said scanning means including at least a first switch for detecting the stopping position of said scanning means; scan starting means coupled to said first switch of said second group of switches for starting movement of said scanning means upon actuation of said first switch of said second group of switches;

a rotation stopping means coupled to said second switch of said first group of switches for stopping the rotation of said photoreceptor drum upon actuation of said second switch of said first group of switches;

a rotation continuing means coupled to said second switch of said first group of switches for preventing the functioning of said rotation stopping means to allow said photoreceptor drum to rotate continuously upon actuation of said second switch of said first group of switches, said rotation continuing means actuated for at least at the first rotation of said photoreceptor drum, wherein said photoreceptor drum makes at least two rotations per copying cycle;

a transfer material feed means for feeding and transporting the transfer material from stock position;

a feed actuation means coupled to said first switch of said first group of switches, said first switch of said second group of switches and said transfer material feed means for actuating said transfer material feed means upon actuation of said first switch of said first group of switches and detection of the stopping position of said scanning means by said first switch of said second group of switches;

a copy number setting means coupled to said feed actuation means, said rotation stopping means, said rotation continuing means, said first switch of said first group of switches and said first switch of said second group of switches, for setting the number of copies to be mode *n*, for actuating said rotation continuing means if said first switch of said first group of switches is actuated and said first switch of said second group of switches does not detect said scanning means in the stopping position, for actuating said rotation continuing means and said feed actuation means if said first switch of said first group of switches is actuated, said first switch of said second group of switches detects said scanning means in the stopping position and the number of copies made is less than *n*, for deactuating said feed actuation means, actuating said rotation continuation means once and then actuating said rotation stopping means if the number of copies made equals *n*.

* * * * *